US011667120B2

(12) United States Patent
Yoda et al.

(10) Patent No.: US 11,667,120 B2
(45) Date of Patent: Jun. 6, 2023

(54) LIQUID DISCHARGE APPARATUS

(71) Applicants: Kazuhisa Yoda, Kanagawa (JP); Yosuke Fukuda, Kanagawa (JP)

(72) Inventors: Kazuhisa Yoda, Kanagawa (JP); Yosuke Fukuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/116,920

(22) Filed: Dec. 9, 2020

(65) Prior Publication Data

US 2021/0197567 A1 Jul. 1, 2021

(30) Foreign Application Priority Data

Dec. 27, 2019 (JP) ..... JP2019-239266
Jul. 16, 2020 (JP) ..... JP2020-121788

(51) Int. Cl.
*B41J 2/165* (2006.01)
*B41J 2/045* (2006.01)
*B41J 2/17* (2006.01)

(52) U.S. Cl.
CPC ..... *B41J 2/16517* (2013.01); *B41J 2/0458* (2013.01); *B41J 2/04541* (2013.01); *B41J 2/04581* (2013.01); *B41J 2/16526* (2013.01); *B41J 2/1721* (2013.01); *B41J 2002/16529* (2013.01); *B41J 2002/1742* (2013.01)

(58) Field of Classification Search
CPC ..... B41J 2002/1742
See application file for complete search history.

(56) References Cited

U.S. PATENT DOCUMENTS

2004/0189737 A1* 9/2004 Nakashima ..... B41J 2/16526 347/23
2006/0132572 A1* 6/2006 Mochizuki ..... B41J 2/16585 347/104
2006/0214979 A1* 9/2006 Inoue ..... B41J 2/16585 347/22
2006/0244792 A1* 11/2006 Tanaka ..... B41J 2/16526 347/85

(Continued)

FOREIGN PATENT DOCUMENTS

JP 2013-067167 4/2013
JP 2014-141020 8/2014

(Continued)

OTHER PUBLICATIONS

Machine generated English translation of JP2017189904A, "Inkjet Recording Apparatus and Inkjet Recording Method"; retrieved from FIT database on Feb. 2, 2022; 24pp. (Year: 2022).*

*Primary Examiner* — Shelby L Fidler
(74) *Attorney, Agent, or Firm* — Duft & Bornsen, PC

(57) ABSTRACT

A liquid discharge apparatus includes a liquid discharger, a discharge receptacle, and circuitry. The liquid discharger includes a nozzle configured to discharge liquid. The discharge receptacle is configured to receive the liquid discharged from the liquid discharger. The circuitry is configured to control a flushing operation of the liquid discharger. The circuitry is configured to cause the liquid discharger to perform flushing to the discharge receptacle and a sheet to which the liquid is applied, with a first flushing amount and a second flushing amount different from the first flushing amount, respectively.

13 Claims, 17 Drawing Sheets

(56) References Cited

U.S. PATENT DOCUMENTS

| | | | | |
|---|---|---|---|---|
| 2010/0023657 | A1 | 1/2010 | Fukuda et al. | |
| 2010/0138578 | A1 | 6/2010 | Fukuda | |
| 2011/0234671 | A1* | 9/2011 | Suzuki | B41J 2/16526 347/14 |
| 2012/0206522 | A1* | 8/2012 | Kanda | B41J 2/16585 347/12 |
| 2013/0076820 | A1 | 3/2013 | Chandu et al. | |
| 2014/0139577 | A1* | 5/2014 | Sato | B41J 2/16526 347/12 |
| 2014/0292869 | A1* | 10/2014 | Mizutani | B41J 2/16526 347/14 |
| 2015/0231886 | A1* | 8/2015 | Yamazaki | B41J 2/16517 347/35 |
| 2016/0089887 | A1* | 3/2016 | Shindo | B41J 2/16508 347/35 |
| 2017/0274659 | A1* | 9/2017 | Morrison | B41J 2/16526 |
| 2019/0329555 | A1 | 10/2019 | Yoda | |
| 2020/0171815 | A1 | 6/2020 | Kanda et al. | |
| 2020/0290342 | A1 | 9/2020 | Yoda | |

FOREIGN PATENT DOCUMENTS

| | | | | |
|---|---|---|---|---|
| JP | 2014-162027 | | 9/2014 | |
| JP | 2015-116719 | | 6/2015 | |
| JP | 2017189904 | A * | 10/2017 | |
| JP | 2019-104214 | | 6/2019 | |
| JP | 2019104214 | A * | 6/2019 | B41J 11/057 |
| JP | 2019-194008 | | 11/2019 | |

* cited by examiner

FIG. 18

| | FLUSHING AREA | | |
|---|---|---|---|
| | F1,F2,F3 | F1,F2 OR<br>F1,F3 OR<br>F2,F3 | F2 |
| AMOUNT REQUIRED PER NOZZLE | 8 | 7 | 6 |

FIG. 19

| | | APPLICABILITY OF FLUSHING | |
|---|---|---|---|
| | | F1 | F3 |
| PRINT CONDITIONS | A | APPLICABLE | NOT APPLICABLE |
| | B | APPLICABLE | APPLICABLE |
| | C | NOT APPLICABLE | APPLICABLE |

| FRONT-TO-BACK ALIGNMENT | PRINT SIDE | LEADING END (F3) | TRAILING END (F1) |
|---|---|---|---|
| YES | FRONT | — | — |
| | BACK | ○ | ○ |
| NO | FRONT | ○ | ○ |
| | BACK | ○ | ○ |

LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2019-239266, filed on Dec. 27, 2019, and 2020-121788, filed on Jul. 16, 2020, in the Japan Patent Office, the entire disclosure of each of which is hereby incorporated by reference herein.

BACKGROUND

Technical Field

Embodiments of the present disclosure relate to a liquid discharge apparatus.

Related Art

In an apparatus including a head that discharges liquid, flushing (also called dummy discharging or purging) may be performed to maintain and recover (as maintenance) the conditions of the head. Specifically, liquid that does not adhere to a target for applying liquid is discharged toward, e.g., a discharge receptacle or a sheet.

SUMMARY

In one embodiment of the present disclosure, a novel liquid discharge apparatus includes a liquid discharger, a discharge receptacle, and circuitry. The liquid discharger includes a nozzle configured to discharge liquid. The discharge receptacle is configured to receive the liquid discharged from the liquid discharger. The circuitry is configured to control a flushing operation of the liquid discharger. The circuitry is configured to cause the liquid discharger to perform flushing to the discharge receptacle and a sheet to which the liquid is applied, with a first flushing amount and a second flushing amount different from the first flushing amount, respectively.

BRIEF DESCRIPTION OF THE DRAWINGS

A more complete appreciation of the embodiments and many of the attendant advantages and features thereof can be readily obtained and understood from the following detailed description with reference to the accompanying drawings, wherein:

FIG. 18 is a table presenting a relationship between areas targeted for flushing and a flushing amount need per nozzle, according to an embodiment of the present disclosure;

FIG. 19 is a table presenting a relationship between print conditions and the applicability of flushing to a sheet, according to a ninth embodiment of the present disclosure;

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
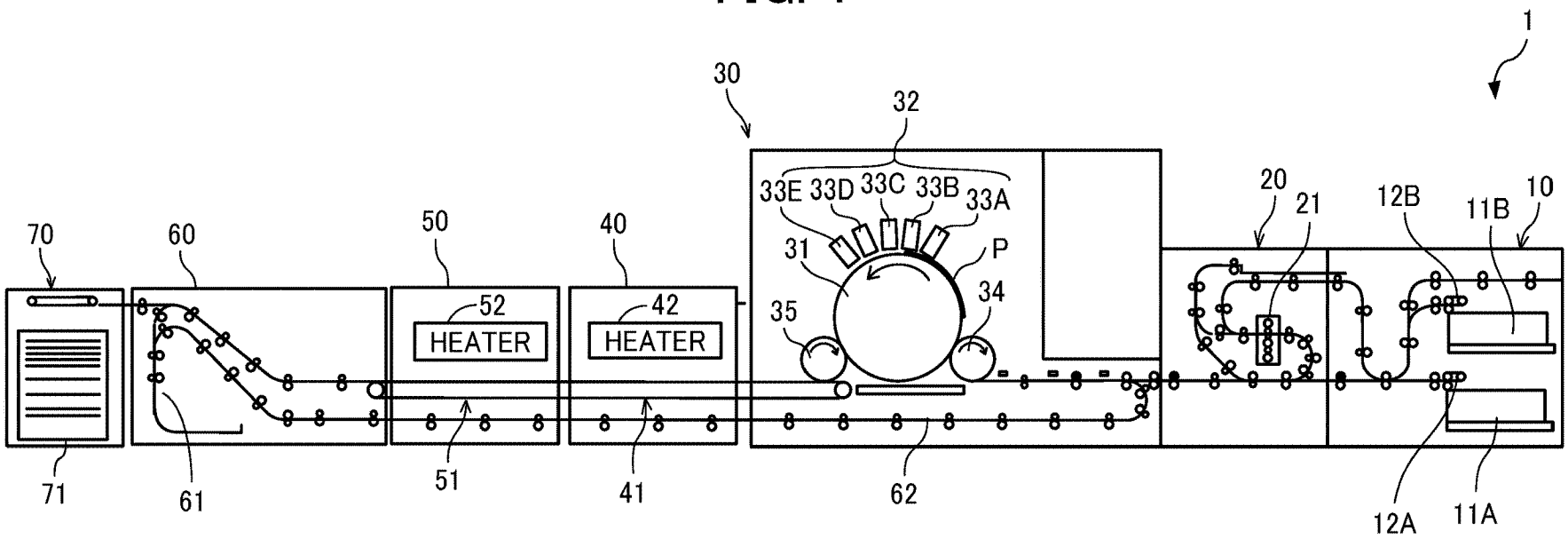
FIG. 1 is a schematic view of a printer as a liquid discharge apparatus according to a first embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity, like reference numerals are given to identical or corresponding constituent elements such as parts and materials having the same functions, and redundant descriptions thereof are omitted unless otherwise required.

As used herein, the singular forms "a," "an," and "the" are intended to include the plural forms as well, unless the context clearly indicates otherwise.

It is to be noted that, in the following description, suffixes Y, M, C, and K denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Figure 2:
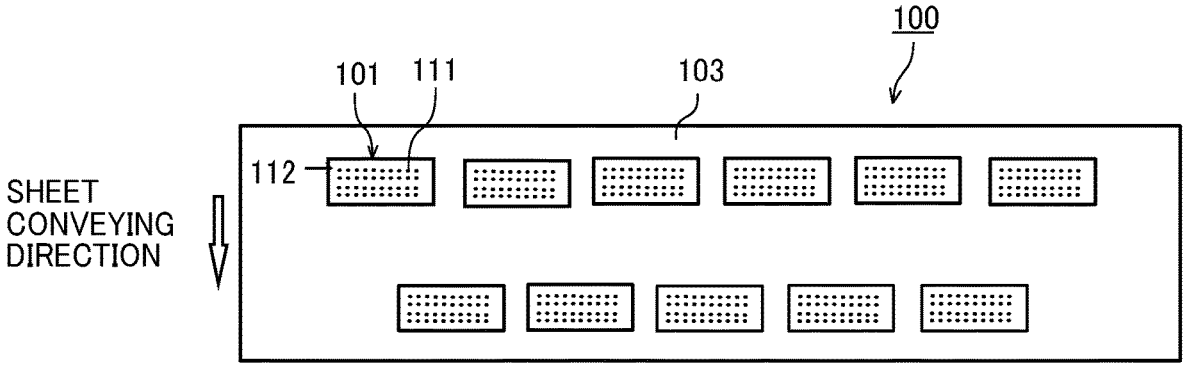
FIG. 2 is a plan view of a discharge unit of the printer illustrated in FIG. 1.
Figure 3:
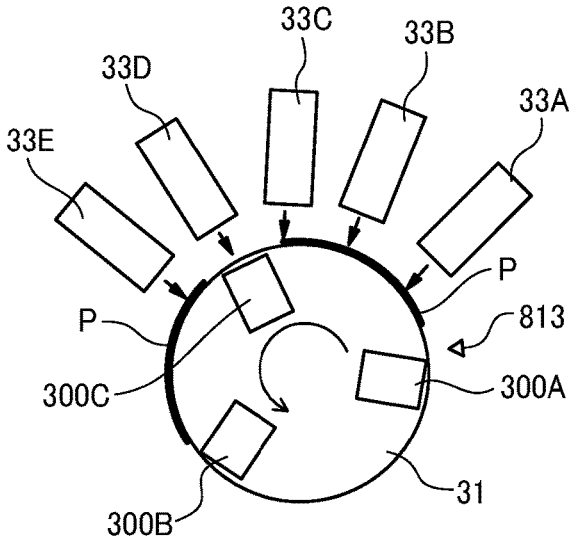
FIG. 3 is an illustration of an arrangement of discharge receptacles in the printer illustrated in FIG. 1.

Referring now to FIGS. 1 to 3, a description is given of a printer as a liquid discharge apparatus according to a first embodiment of the present disclosure.

FIG. 1 is a schematic view of the printer. FIG. 2 is a plan view of a discharge unit of the printer. FIG. 3 is an illustration of an arrangement of discharge receptacles in the printer.

The printer 1 includes a loading device 10 that loads a sheet P into the printer 1, a pretreatment device 20 serving as an applying device, a printing device 30, a first drying device 40, a second drying device 50, a reversing assembly 60, and an unloading device 70. In the printer 1, the pretreatment device 20 imparts (or applies), as required, a pretreatment liquid as a coating liquid onto the sheet P loaded (or supplied) from the loading device 10. The printing device 30 applies the liquid to the sheet P to perform printing.

The first drying device 40 and the second drying device 50 dry the liquid adhering to the sheet P. The printer 1 then ejects the sheet P as is, or after subjecting the sheet P to double-sided printing, to the unloading device 70 via the reversing assembly 60.

The loading device 10 includes loading trays 11 (specifically, a lower loading tray 11A and an upper loading tray 11B) and feeders 12 (specifically, a feeder 12A and a feeder 12B). The loading trays 11 accommodate a plurality of sheets P. The feeders 12 separate and feed the plurality of sheets P one at a time from the loading trays 11. Thus, the loading device 10 supplies the plurality of sheets P to the pretreatment device 20.

The pretreatment device 20 includes, e.g., a coater 21 serving as a treatment-liquid applier that coats a print side (or an image formation surface) of the sheet P with a treatment liquid having an effect of aggregating ink particles to prevent bleed-through.

The printing device 30 includes a drum 31 and a liquid discharge section 32. The drum 31 is a bearer (or a rotator) that bears the sheet P on a circumferential surface of the drum 31 and rotates. The liquid discharge section 32 discharges liquid toward the sheet P borne on the drum 31.

The printing device 30 further includes transfer cylinders 34 and 35. The transfer cylinder 34 receives the sheet P from the pretreatment device 20 and forwards the sheet P to the drum 31. The transfer cylinder 35 receives the sheet P conveyed by the drum 31 and forwards the sheet P to the first drying device 40.

The transfer cylinder 34 includes a sheet gripper to grip the leading end of the sheet P conveyed from the pretreatment device 20 to the printing device 30. The sheet P thus gripped is conveyed as the transfer cylinder 34 rotates. The transfer cylinder 34 conveys and forwards the sheet P to the drum 31 at a position opposite the drum 31.

Similarly, the drum 31 includes a sheet gripper on the surface of the drum 31 to grip the leading end of the sheet P. A plurality of suction holes is dispersed on the surface of the drum 31. A suction device generates a suction airflow directed inward from the plurality of suction holes of the drum 31.

The sheet gripper of the drum 31 grips the leading end of the sheet P forwarded from the transfer cylinder 34 to the drum 31 while the suction device generates the suction air flow so that the sheet P is attracted to and borne on the drum 31. As the drum 31 rotates, the sheet P is conveyed.

The liquid discharge section 32 includes discharge units 33 (specifically, discharge units 33A to 33D) serving as liquid appliers. For example, the discharge unit 33A discharges a liquid of cyan (C). The discharge unit 33B discharges a liquid of magenta (M). The discharge unit 33C discharges a liquid of yellow (Y). The discharge unit 33D discharges a liquid of black (K). The discharge unit 33E is used to discharge a special liquid, that is, a liquid of spot color such as white, gold, or silver.

As illustrated in FIG. 2, for example, each of the discharge units 33 includes a head array 100 as a liquid discharger that includes a full-line head in which a plurality of liquid discharge heads 101 (hereinafter simply referred to as "heads 101") is arrayed in a staggered manner on a base 103. Each of the heads 101 includes a plurality of nozzle rows 112. Each of the plurality of nozzle rows 112 is an array of nozzles 111. In addition, a sub tank (or a liquid container) is provided to store the liquid to be supplied to each of the heads 101 of the head array 100.

The discharge operation of each of the discharge units 33 of the liquid discharge section 32 is controlled by a drive signal corresponding to print data. When the sheet P borne on the drum 31 passes through an area opposite the liquid discharge section 32, the discharge units 33 discharge the respective color liquids to form or print an image according to the print data.

As illustrated in FIG. 3, a plurality of discharge receptacles 300 (in this case, three discharge receptacles 300A, 300B, and 300C) is arranged on the drum 31 at substantially equal angles. In order to maintain and recover the heads 101 of the discharge unit 33, a dummy discharge operation is performed to the discharge receptacles 300. Specifically, the liquid (or dummy discharge drops) not applied to the sheet P is discharged to the discharge receptacles 300. The discharge receptacles 300 also receive the liquid that fails to be applied onto the sheet P during borderless printing, for example.

The first drying device 40 includes a heater 42 such as an IR heater. The first drying device 40 irradiates the sheet P, bearing the liquid and conveyed by a conveyor 41, with infrared rays to heat and dry the sheet P. The second drying device 50 includes a heater 52 such as an ultraviolet irradiator. The second drying device 50 irradiates the sheet P, bearing the liquid and conveyed by a conveyor 51 after passing through the first drying device 40, with infrared rays to heat and dry the sheet P. Note that the conveyor 41 and the conveyor 51 are part of a common conveying device.

The reversing assembly 60 includes a reverser 61 and a double-sided printing conveyor 62. For double-sided printing of the sheet P bearing the liquid on one side and dried through the first drying device 40 and the second drying device 50, the reverser 61 reverses the sheet P in a switchback manner. The double-sided printing conveyor 62 feeds the reversed sheet P back to an upstream position from the transfer cylinder 34 of the printing device 30 in a sheet conveying direction in which the sheet P is conveyed.

The unloading device 70 includes an unloading tray 71 on which the plurality of sheets P is stacked. The sheets P conveyed one at a time through the reversing assembly 60 are sequentially stacked and held on the unloading tray 71.

Note that, in the present embodiment, the sheet P is described as a cut sheet, for example. However, the embodiments of the present disclosure are also applicable to an apparatus that uses a large-sized sheet such as wallpaper.

Figure 4:
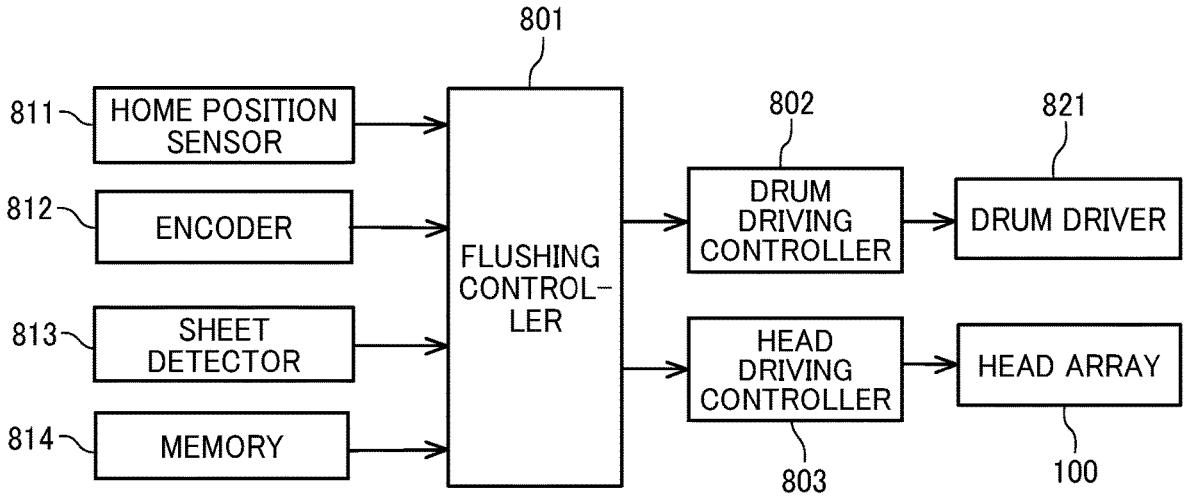
FIG. 4 is a block diagram illustrating components related to flushing control of the printer illustrated in FIG. 1.

Referring now to FIG. 4, a description is given of components related to flushing control.

FIG. 4 is a block diagram illustrating the components related to flushing control of the printer 1.

A flushing controller 801 controls a flushing operation performed to the discharge receptacles 300 and a flushing operation performed to the sheet P.

The flushing controller 801 inputs or reads stored information of a home position sensor 811, an encoder 812, a sheet detector 813, and a memory 814.

The home position sensor 811 outputs a home position detection signal when a home position filler that orbits with the rotation of the drum 31 passes through a home position. The encoder 812 reads an encoder wheel that rotates with the drum 31 with an encoder sensor and outputs a pulse.

As illustrated in FIG. 3, the sheet detector 813 detects the sheet P (specifically, the leading end, the trailing end, or opposed widthwise ends of the sheet P) at a position upstream from the discharge unit 33A in a direction of rotation of the drum 31. Note that the location of the sheet detector 813 is not limited to the location illustrated in FIG. 3. Alternatively, for example, the sheet detector 813 may be located upstream from the transfer cylinder 34 in the direction of rotation of the drum 31.

The memory 814 stores information of, e.g., the applicability of flushing to the sheet P according to the print conditions and an amount of flushing (hereinafter referred to as a flushing amount) required to stabilize the discharging of the heads 101.

The flushing controller 801 drives, via a drum driving controller 802, a drum driver 821 to rotate the drum 31 so as to move the discharge receptacle 300 to a position opposite the head array 100.

The flushing controller 801 drives and controls, via a head driving controller 803, each of the heads 101 of the head array 100 of each of the discharge units 33 to perform flushing, specifically, to discharge liquid that does not contribute to image formation.

Now, a description is given of an outline of control, by the flushing controller 801, of the flushing operations to the discharge receptacle 300 and the sheet P.

The flushing controller 801 starts counting the number of output pulses of the encoder 812 at the time when the home position sensor 811 detects the home position of the drum 31 until the first discharge receptacle 300A reaches the position opposite the head array 100.

When the number counted indicates that the discharge receptacle 300A reaches the position opposite the head array 100, the flushing controller 801 gives, via the head driving controller 803, flushing driving information to each of the heads 101 of the head array 100 to cause each of the heads 101 to perform flushing to the discharge receptacle 300A. Note that, when the count value indicates that discharge receptacle 300A reaches the position opposite the head array 100, the flushing controller 801 may use another piece of count information to specify a position within the discharge receptacle 300A in a moving direction (i.e., direction of rotation of the drum 31).

The flushing controller 801 resumes counting the number of output pulses of the encoder 812 until the second discharge receptacle 300B reaches the position opposite the head array 100.

When the number counted indicates that the discharge receptacle 300B reaches the position opposite the head array 100, the flushing controller 801 gives, via the head driving controller 803, the flushing driving information to each of the heads 101 of the head array 100 to cause each of the heads 101 to perform flushing to the discharge receptacle 300B. Note that, when the count value indicates that discharge receptacle 300B reaches the position opposite the head array 100, the flushing controller 801 may use another piece of count information to specify a position within the discharge receptacle 300B in the moving direction (i.e., direction of rotation of the drum 31).

The flushing controller 801 further resumes counting the number of output pulses of the encoder 812 until the third discharge receptacle 300C reaches the position opposite the head array 100.

When the number counted indicates that the discharge receptacle 300C reaches the position opposite the head array 100, the flushing controller 801 gives, via the head driving controller 803, the flushing driving information to each of the heads 101 of the head array 100 to cause each of the heads 101 to perform flushing to the discharge receptacle 300C. Note that, when the count value indicates that discharge receptacle 300C reaches the position opposite the head array 100, the flushing controller 801 may use another piece of count information to specify a position within the discharge receptacle 300C in the moving direction (i.e., direction of rotation of the drum 31).

When the drum 31 makes one rotation, the home position sensor 811 detects the home position of the drum 31. Accordingly, the flushing controller 801 resets the value counted until the detection of the home position and starts counting the output pulses of the encoder 812 that rotates with the drum 31.

On the other hand, when the sheet detector 813 detects the leading end of the sheet P, the flushing controller 801 causes, via the head driving controller 803, each of the heads 101 of the head array 100 to perform flushing to the leading and trailing end portions of the sheet P.

The flushing controller 801 starts counting encoder signals of the encoder 812 at the time when sheet detector 813 detects the leading end of the sheet P, thus detecting (or determining) the respective flushing positions of the leading and trailing end portions of the sheet P. For example, the flushing controller 801 counts the number of signals for a given length from the leading end of the sheet P detected by the sheet detector 813 to the leading end portion of the sheet P or to the trailing end portion of the sheet P.

Here, the flushing controller 801 is configured to change a flushing amount per nozzle by the head (i.e., for each of the heads 101) in the discharge receptacle 300. Accordingly, the flushing controller 801 may reduce the amount of liquid that is discharged to the discharge receptacle 300 when the flushing is not applicable to the sheet P.

Alternatively, the flushing controller 801 may be configured to change the flushing amount per nozzle by the nozzle (i.e., for each of the nozzles 111) in the discharge receptacle 300. Accordingly, the flushing controller 801 may reduce the amount of liquid that is discharged to the discharge receptacle 300 when the flushing is not applicable to the sheet P. For example, when the flushing is not applicable to the sheet P, the heads 101 or nozzles 111 may be changed individually, in rows or in a given number, to sequentially discharge the liquid (dummy discharge drops) to the discharge receptacle 300. Alternatively, the head 101 or nozzle 111 that has not discharged the liquid to the discharge receptacle 300 at the time of the previous flushing may be selected to discharge the liquid.

Figure 5:
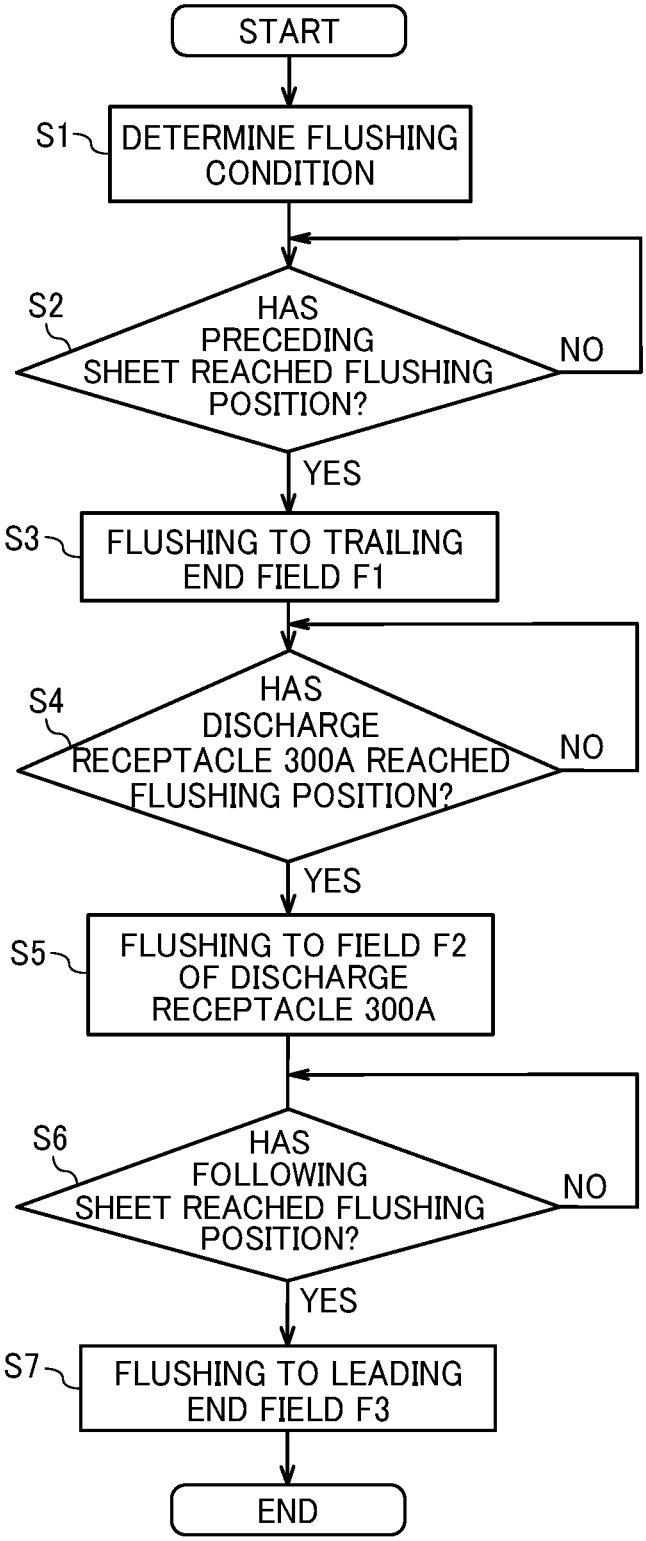
FIG. 5 is a flowchart of control of a flushing operation according to a first embodiment of the present disclosure.
Figure 6:
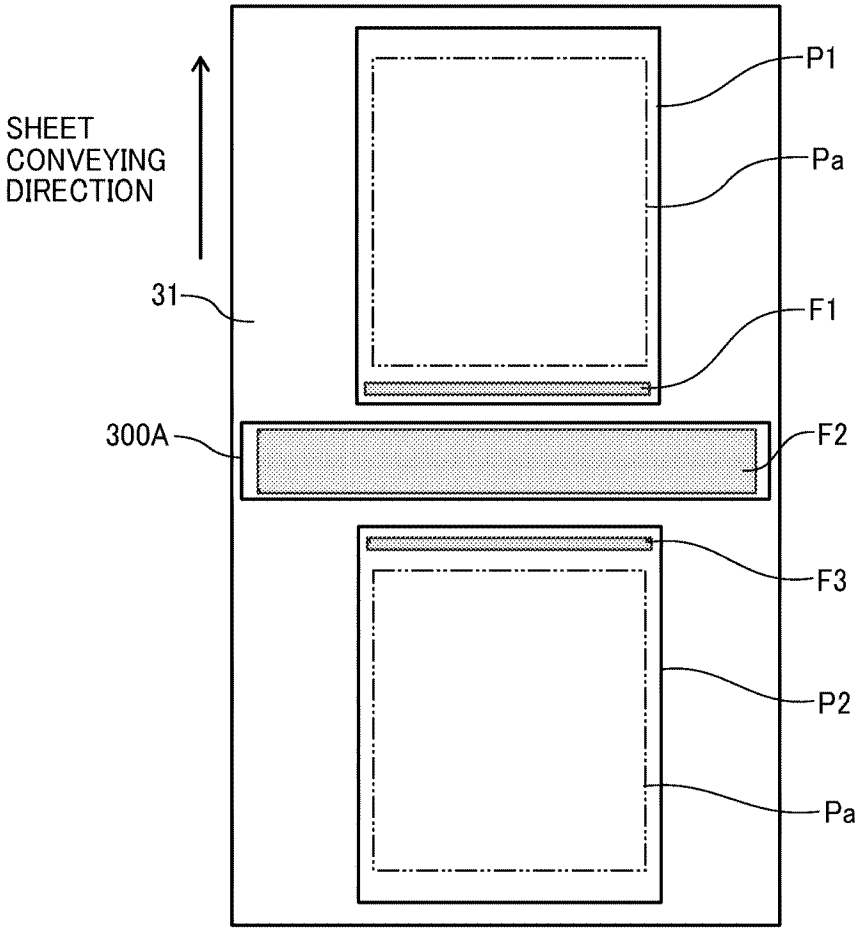
FIG. 6 is a plan view of a drum in a developed state, illustrating the control of the flushing operation according to the first embodiment of the present disclosure.

Referring now to FIGS. 5 and 6, a description is given of control of a flushing operation according to the first embodiment of the present disclosure.

FIG. 5 is a flowchart of the control of the flushing operation according to the first embodiment of the present disclosure. FIG. 6 is a plan view of the drum 31 in a developed state, illustrating the control of the flushing operation according to the first embodiment of the present disclosure.

Here, as illustrated in FIG. 6, a preceding sheet P1 is one located downstream from the other one of two continuous sheets P in the sheet conveying direction (i.e., direction of rotation of the drum 31), whereas a following sheet P2 is located upstream from the preceding sheet P1 in the sheet conveying direction. A trailing end field F1 is a flushing area, which is an area targeted for flushing, at the trailing end portion of the sheet P, whereas a leading end field F3 is a flushing area at the leading end portion of the sheet P. A field F2, which may be hereinafter referred to as a flushing field F2, is a flushing area of the discharge receptacle 300 (namely, discharge receptacle 300A). The same applies to the other embodiments described below.

In the present embodiment, the flushing amount for flushing to the discharge receptacle 300 is different from the flushing amount for flushing to the sheet P.

In step S1, the flushing controller 801 determines a flushing condition for discharging liquid from the heads 101. Flushing conditions are stored in the memory 814. Here, the flushing controller 801 acquires flushing information for the trailing end field F1 of the preceding sheet P1, the field F2 of the discharge receptacle 300A, and the leading end field F3 of the following sheet P2.

In step S2, the flushing controller 801 determines whether the trailing end field F1 of the preceding sheet P1 has reached a flushing position opposite the head array 100. When the flushing controller 801 determines that the trailing end field F1 of the preceding sheet P1 has not reached the flushing position (NO in step S2), the determination in step S2 is repeated. On the other hand, when the flushing controller 801 determines that the trailing end field F1 of the preceding sheet P1 has reached the flushing position (YES in step S2), in step S3, the flushing is performed to the trailing end field F1 of the preceding sheet P1. Specifically, the heads 101 discharge the liquid to the trailing end field F1 of the preceding sheet P1.

At this time, the flushing controller 801 counts the number of flushing signals input to the head driving controller 803 and causes the heads 101 to discharge the liquid until the counted number matches the count value stored in the memory 814.

In step S4, the flushing controller 801 determines whether the discharge receptacle 300A has reached the flushing position. When the flushing controller 801 determines that the discharge receptacle 300A has not reached the flushing position (NO in step S4), the determination in step S4 is repeated. On the other hand, when the flushing controller 801 determines that the discharge receptacle 300A has reached the flushing position (YES in step S4), in step S5, the flushing is performed to the field F2 of the discharge receptacle 300A. Specifically, the heads 101 discharge the liquid to the field F2 of the discharge receptacle 300A.

At this time, the flushing controller 801 counts the number of flushing signals input to the head driving controller 803 and causes the heads 101 to discharge the liquid until the counted number matches the count value stored in the memory 814.

In step S6, the flushing controller 801 determines whether the leading end field F3 of the following sheet P2 has reached the flushing position opposite the head array 100. When the flushing controller 801 determines that the leading end field F3 of the following sheet P2 has not reached the flushing position (NO in step S6), the determination in step S6 is repeated. On the other hand, when the flushing controller 801 determines that the leading end field F3 of the following sheet P2 has reached the flushing position (YES in step S6), in step S7, the flushing is performed to the leading end field F3 of the following sheet P2. Specifically, the heads 101 discharge the liquid to the leading end field F3 of the following sheet P2.

At this time, the flushing controller 801 counts the number of flushing signals input to the head driving controller 803 and causes the heads 101 to discharge the liquid until the counted number matches the count value stored in the memory 814.

Here, the flushing amount for flushing to the field F2 of the discharge receptacle 300A is different from at least one of the flushing amount for flushing to the trailing end field F1 of the preceding sheet P1 and the flushing amount for flushing to the leading end field F3 of the following sheet P2. Note that the flushing amount is an amount of the liquid (or dummy discharge drops) discharged at the time of flushing, and more specifically, the number of drops discharged from one nozzle 111. Note that the flushing amount for flushing to the trailing end field F1 of the preceding sheet P1 may be identical to or different from the flushing amount for flushing to the leading end field F3 of the following sheet P2.

In the case of flushing to a discharge receptacle, generally, the discharge receptacle is to be replaced (including the replacement of a liquid holder housed in the discharge receptacle) when the discharge receptacle is full. In order to reduce the downtime due to the replacement work of the discharge receptacle, the frequency of replacement of the discharge receptacle is to be reduced.

According to the present embodiment, the difference in flushing amount allows reduction of the flushing amount for flushing to the discharge receptacle 300, thus extending the replacement span of the discharge receptacle 300 and reducing the frequency of replacement of the discharge receptacle 300. The liquid consumption is also reduced.

Note that the flushing amount for flushing to the trailing end field F1 may be different from the flushing amount for flushing to the leading end field F3. The flushing amount for flushing to one of the trailing end field F1 and the leading end field F3 may be identical to the flushing amount for flushing to the field F2.

A flushing amount V1 as a total number of drops discharged from one nozzle 111 to the trailing end field F1, the field F2, and the leading end field F3 is not less than a predetermined flushing amount V2 with which the nozzles 111 that are used for a print area Pa of the following sheet P2 can stably discharge the liquid.

That is, the flushing controller 801 controls the flushing to the trailing end field F1 of the preceding sheet P1, the field F2 of the discharge receptacle 300A, and the leading end field F3 of the following sheet P2. Even when the flushing to the trailing end field F1 covers the required flushing amount (i.e., flushing amount V2), the flushing controller 801 causes the heads 101 to perform the flushing to at least one of the leading end field F3 of the following sheet P2 and the field F2 of the discharge receptacle 300A, in addition to the trailing end field F1 of the preceding sheet P1.

Accordingly, the print quality is guaranteed even when the trailing end field F1 of the preceding sheet P1 is distanced from the print area Pa of the following sheet P2, that is, even when the decap time is relatively long.

Figure 7:
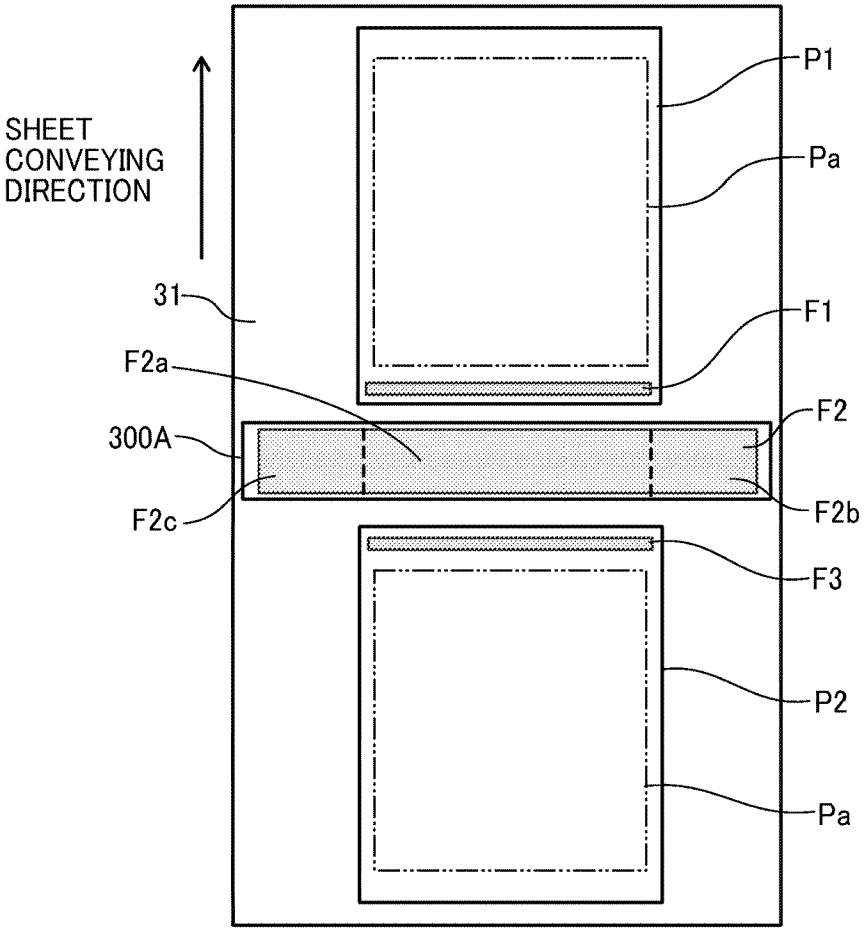
FIG. 7 is a plan view of a drum in a developed state, illustrating control of a flushing operation according to a second embodiment of the present disclosure.

Referring now to FIG. 7, a description is given of control of a flushing operation according to a second embodiment of the present disclosure.

FIG. 7 is a plan view of the drum 31 in a developed state, illustrating the control of the flushing operation according to the second embodiment of the present disclosure.

In the present embodiment, a flushing amount V1 as a total number of drops discharged from one nozzle 111 to the trailing end field F1, the field F2, and the leading end field F3 is not less than a predetermined flushing amount V2 with which the nozzles 111 that are used for the print area Pa of the following sheet P2 can stably discharge the liquid. The flushing amount V1 is divided for flushing to the trailing end field F1, the field F2, and the leading end field F3.

For example, "6" is set as a flushing amount required for one nozzle 111, for stable liquid discharging to the print area Pa of the following sheet P2. In the present example, the flushing amount "6" is divided into a flushing amount "2" for flushing to the trailing end field F1 of the preceding sheet P1, a flushing amount "2" for flushing to a center field F2*a* of the field F2 of the discharge receptacle 300A, and a flushing amount "2" for flushing to the leading end field F3 of the following sheet P2.

On the other hand, the flushing amount for flushing to longitudinal end fields F2*b* and F2*c* of the field F2 of the discharge receptacle 300A is the number of drops (i.e., flushing amount) that does not dry the meniscus in the nozzle 111. Note that a longitudinal direction of the discharge receptacle 300 is parallel to a width direction of the sheet P. This is because no print area Pa of the following sheet P2 exists upstream from the longitudinal end fields F2*b* and F2*c* of the field F2 in the sheet conveying direction.

Thus, in this case, the number of drops (i.e., flushing amount) for flushing to the center field F2*a* of the discharge receptacle 300A is different from the number of drops (i.e., flushing amount) for flushing to the longitudinal end fields F2*b* and F2*c* of the discharge receptacle 300A.

In a case in which the flushing amount for flushing to the trailing end field F1, the flushing amount for flushing to the center field F2*a*, and the flushing amount for flushing to the leading end field F3 are different from each other, the flushing amount may be, e.g., two drops, one drop, and three drops for the trailing end field F1, the center field F2*a*, and the leading end field F3, respectively.

As described above, in the flushing to the discharge receptacle 300, the distribution of the flushing amount (i.e., number of drops) for flushing to an area of the discharge receptacle 300 corresponding to an outside of the print area Pa in the width direction of the sheet P, which is a direction perpendicular to the sheet conveying direction, is applicable to the first embodiment described above and embodiments described below.

The flushing operation may be performed once in a predetermined number of times for the longitudinal end fields F2*b* and F2*c* of the discharge receptacle 300, which do not face the sheet P. That is, the flushing may not be performed for each time when the sheet P passes by longitudinal end fields F2*b* and F2*c* of the discharge receptacle 300.

Figure 8:
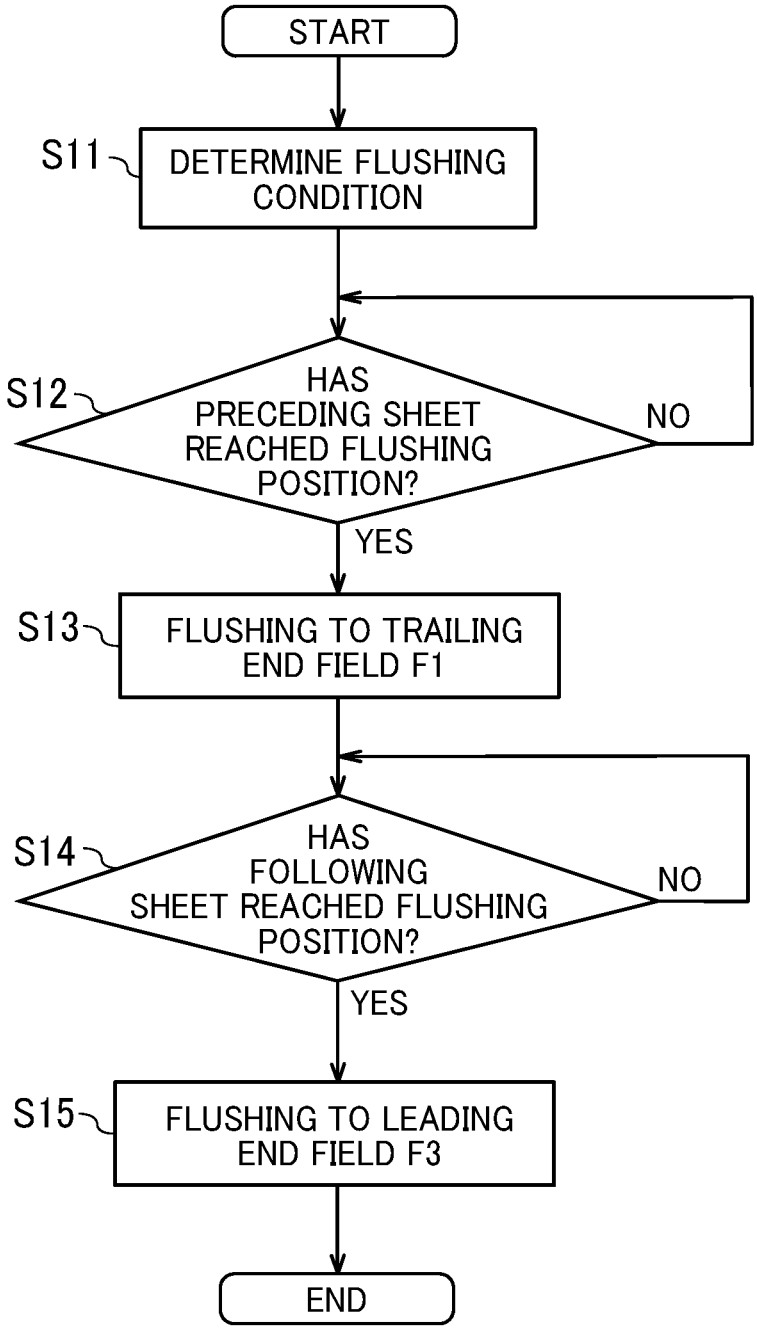
FIG. 8 is a flowchart of control of a flushing operation according to a third embodiment of the present disclosure.
Figure 9:
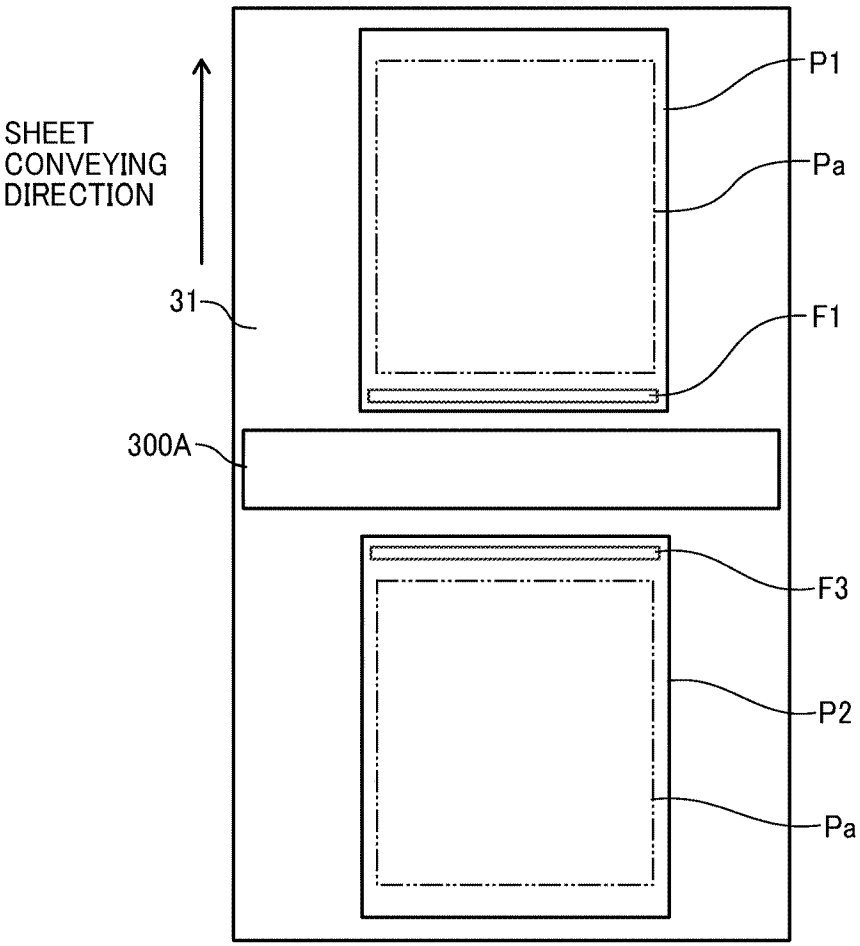
FIG. 9 is a plan view of a drum in a developed state, illustrating the control of the flushing operation according to the third embodiment of the present disclosure.

Referring now to FIGS. 8 and 9, a description is given of control of a flushing operation according to a third embodiment of the present disclosure.

FIG. 8 is a flowchart of the control of the flushing operation according to the third embodiment of the present disclosure. FIG. 9 is a plan view of the drum 31 in a developed state, illustrating the control of the flushing operation according to the third embodiment of the present disclosure.

In step S11, the flushing controller 801 determines a flushing condition for discharging liquid from the heads 101. Flushing conditions are stored in the memory 814. Here, the flushing controller 801 acquires flushing information for the trailing end field F1 of the preceding sheet P1 and the leading end field F3 of the following sheet P2.

In step S12, the flushing controller 801 determines whether the trailing end field F1 of the preceding sheet P1 has reached a flushing position opposite the head array 100. When the flushing controller 801 determines that the trailing end field F1 of the preceding sheet P1 has not reached the flushing position (NO in step S12), the determination in step S12 is repeated. On the other hand, when the flushing controller 801 determines that the trailing end field F1 of the preceding sheet P1 has reached the flushing position (YES in step S12), in step S13, the flushing is performed to the trailing end field F1 of the preceding sheet P1. Specifically, the heads 101 discharge the liquid to the trailing end field F1 of the preceding sheet P1.

In step S14, the flushing controller 801 determines whether the leading end field F3 of the following sheet P2 has reached the flushing position opposite the head array 100. When the flushing controller 801 determines that the leading end field F3 of the following sheet P2 has not reached the flushing position (NO in step S14), the determination in step S14 is repeated. On the other hand, when the flushing controller 801 determines that the leading end field F3 of the following sheet P2 has reached the flushing position (YES in step S14), in step S15, the flushing is performed to the leading end field F3 of the following sheet P2. Specifically, the heads 101 discharge the liquid to the leading end field F3 of the following sheet P2.

Thus, the field F2 of the discharge receptacle 300A is not subjected to flushing. In short, the flushing amount is 0. That is, the flushing amount for flushing to the discharge receptacle 300A is different from at least one of the flushing amount for flushing to the trailing end field F1 of the preceding sheet P1 and the flushing amount for flushing to the leading end field F3 of the following sheet P2. Note that the flushing amount for flushing to the trailing end field F1 of the preceding sheet P1 may be identical to or different from the flushing amount for flushing to the leading end field F3 of the following sheet P2.

Accordingly, the flushing amount for flushing to the discharge receptacle 300 is further reduced, resulting in extension of the replacement span of the discharge receptacle 300 and reduction in frequency of replacement of the discharge receptacle 300. In addition, the liquid consumption is further reduced.

Note that the flushing amount for flushing to the trailing end field F1 may be different from the flushing amount for flushing to the leading end field F3.

A flushing amount V1 as a total number of drops discharged from one nozzle 111 to the trailing end field F1 and the leading end field F3 is not less than a predetermined flushing amount V2 with which the nozzles 111 that are used for the print area Pa of the following sheet P2 can stably discharge the liquid.

Similar to the second embodiment, the flushing amount V1, which is a total number of drops discharged from one nozzle 111 to the trailing end field F1 and the leading end field F3 and not less than the predetermined flushing amount V2 with which the nozzles 111 that are used for the print area Pa of the following sheet P2 can stably discharge the liquid, is dividable for flushing to the trailing end field F1 and the leading end field F3.

Figure 10:
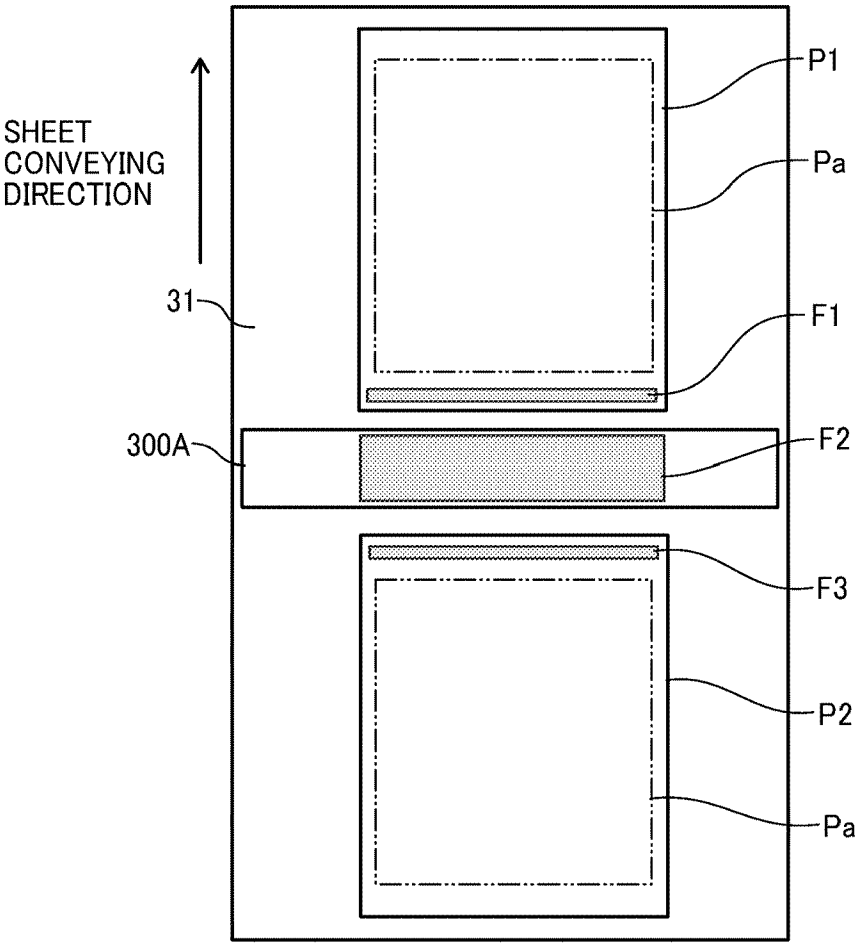
FIG. 10 is a plan view of a drum in a developed state, illustrating control of a flushing operation according to a fourth embodiment of the present disclosure.

Referring now to FIG. 10, a description is given of control of a flushing operation according to a fourth embodiment of the present disclosure.

FIG. 10 is a plan view of the drum 31 in a developed state, illustrating the control of the flushing operation according to the fourth embodiment of the present disclosure.

The present embodiment is an example in which the flushing area of the discharge receptacle 300 has a different length from the length of the flushing area of the discharge receptacle 300 described in the embodiments above in the width direction of the sheet P. The heads 101 may not discharge liquid for flushing over an entire longitudinal area of the discharge receptacle 300A, provided that the nozzles 111 that are used for the print area Pa of the following sheet P2 stably discharge the liquid.

In the present embodiment, the flushing is performed with the nozzles 111 that are used for the print area Pa of the following sheet P2. When viewed as illustrated in FIG. 10, the flushing field F2 of the discharge receptacle 300A is as wide as the leading end field F3, or slightly wider than the leading end field F3 to cover a variation in the width direction of the sheet P in addition to the leading end field F3.

In the present example, the flushing amount for flushing to the field F2 is different from the flushing amount for flushing to the trailing end field F1. Similarly, the flushing amount for flushing to the field F2 is different from the flushing amount for flushing to the leading end field F3.

Accordingly, as compared with the embodiments described above, the flushing amount for flushing to the discharge receptacle 300 is further reduced, resulting in extension of the replacement span of the discharge receptacle 300 and reduction in frequency of replacement of the discharge receptacle 300. The liquid consumption is also reduced.

Note that the number of nozzles 111 that perform the flushing to the discharge receptacle 300A may be larger in the width direction of the sheet P than the nozzles 111 that are used for the print area Pa of the following sheet P2.

Accordingly, even when the following sheet P2 is displaced in the width direction of the sheet P or even when various sizes of sheets P are conveyed, the nozzles 111 that are used for the print area Pa of the following sheet P2 can stably discharge the liquid.

Figure 11:
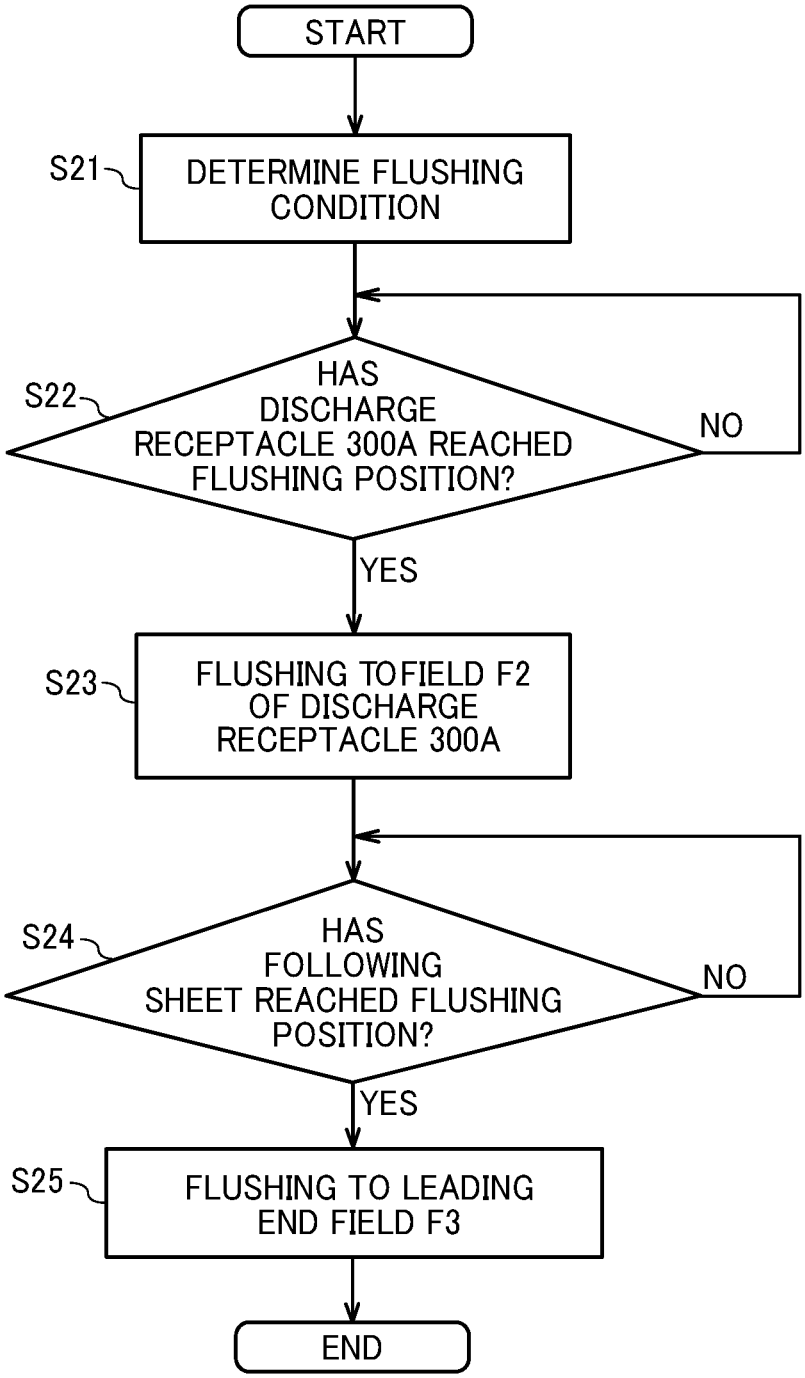
FIG. 11 is a flowchart of control of a flushing operation according to a fifth embodiment of the present disclosure.
Figure 12:
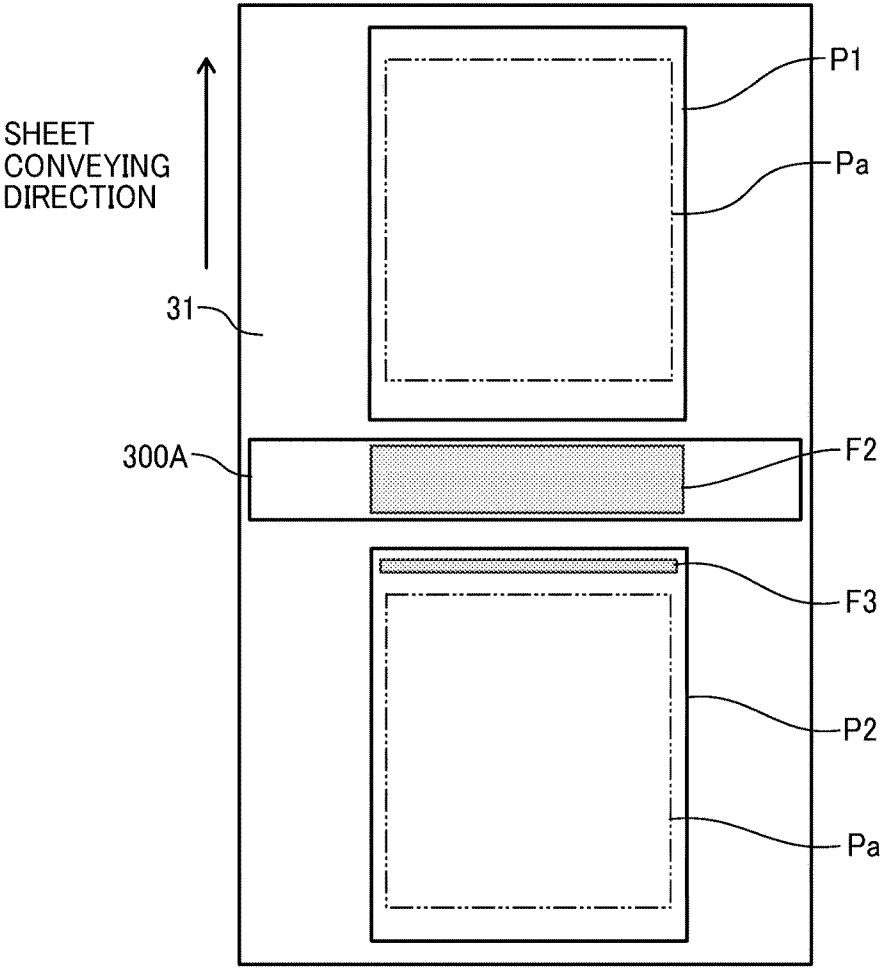
FIG. 12 is a plan view of a drum in a developed state, illustrating the control of the flushing operation according to the fifth embodiment of the present disclosure.

Referring now to FIGS. 11 and 12, a description is given of control of a flushing operation according to a fifth embodiment of the present disclosure.

FIG. 11 is a flowchart of the control of the flushing operation according to the fifth embodiment of the present disclosure. FIG. 12 is a plan view of the drum 31 in a developed state, illustrating the control of the flushing operation according to the fifth embodiment of the present disclosure.

In step S21, the flushing controller 801 determines a flushing condition for discharging liquid from the heads 101. Flushing conditions are stored in the memory 814. Here, the flushing controller 801 acquires flushing information for the field F2 of the discharge receptacle 300A and the leading end field F3 of the following sheet P2.

In step S22, the flushing controller 801 determines whether the field F2 of the discharge receptacle 300A has reached a flushing position opposite the head array 100, without performing the flushing when the trailing end field F1 of the preceding sheet P1 reaches the flushing position opposite the head array 100. When the flushing controller 801 determines that the field F2 of the discharge receptacle 300A has not reached the flushing position (NO in step S22), the determination in step S22 is repeated. On the other hand, when the flushing controller 801 determines that the field F2 of the discharge receptacle 300A has reached the flushing position (YES in step S22), in step S23, the flushing is performed to the field F2 of the discharge receptacle 300A. Specifically, the heads 101 discharge the liquid to the field F2 of the discharge receptacle 300A.

In step S24, the flushing controller 801 determines whether the leading end field F3 of the following sheet P2 has reached the flushing position opposite the head array 100. When the flushing controller 801 determines that the leading end field F3 of the following sheet P2 has not reached the flushing position (NO in step S24), the determination in step S24 is repeated. On the other hand, when the flushing controller 801 determines that the leading end field F3 of the following sheet P2 has reached the flushing position (YES in step S24), in step S25, the flushing is performed to the leading end field F3 of the following sheet P2. Specifically, the heads 101 discharge the liquid to the leading end field F3 of the following sheet P2.

In the present example, the flushing amount for flushing to the field F2 of the discharge receptacle 300A is different from the flushing amount for flushing to the leading end field F3 of the following sheet P2.

Accordingly, the flushing amount for flushing to the discharge receptacle 300 is reduced, resulting in extension of the replacement span of the discharge receptacle 300 and reduction in frequency of replacement of the discharge receptacle 300. The liquid consumption is also reduced.

In the present embodiment, a flushing amount V1 as a total number of drops discharged from one nozzle 111 to the field F2 of the discharge receptacle 300A and the leading end field F3 is not less than a predetermined flushing amount V2 with which the nozzles 111 that are used for the print area Pa of the following sheet P2 can stably discharge the liquid.

Similar to the second embodiment, the flushing amount V1, which is a total number of drops discharged from one nozzle 111 to the field F2 and the leading end field F3 and not less than the predetermined flushing amount V2 with which the nozzles 111 that are used for the print area Pa of the following sheet P2 can stably discharge the liquid, is dividable for flushing to the field F2 and the leading end field F3.

Figure 13:
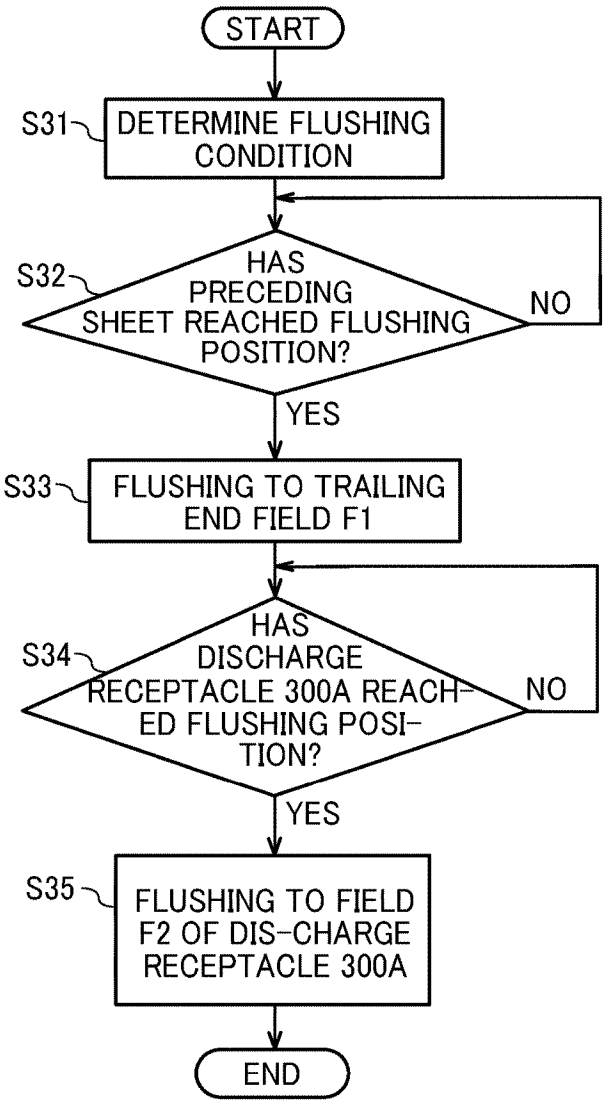
FIG. 13 is a flowchart of control of a flushing operation according to a sixth embodiment of the present disclosure.
Figure 14:
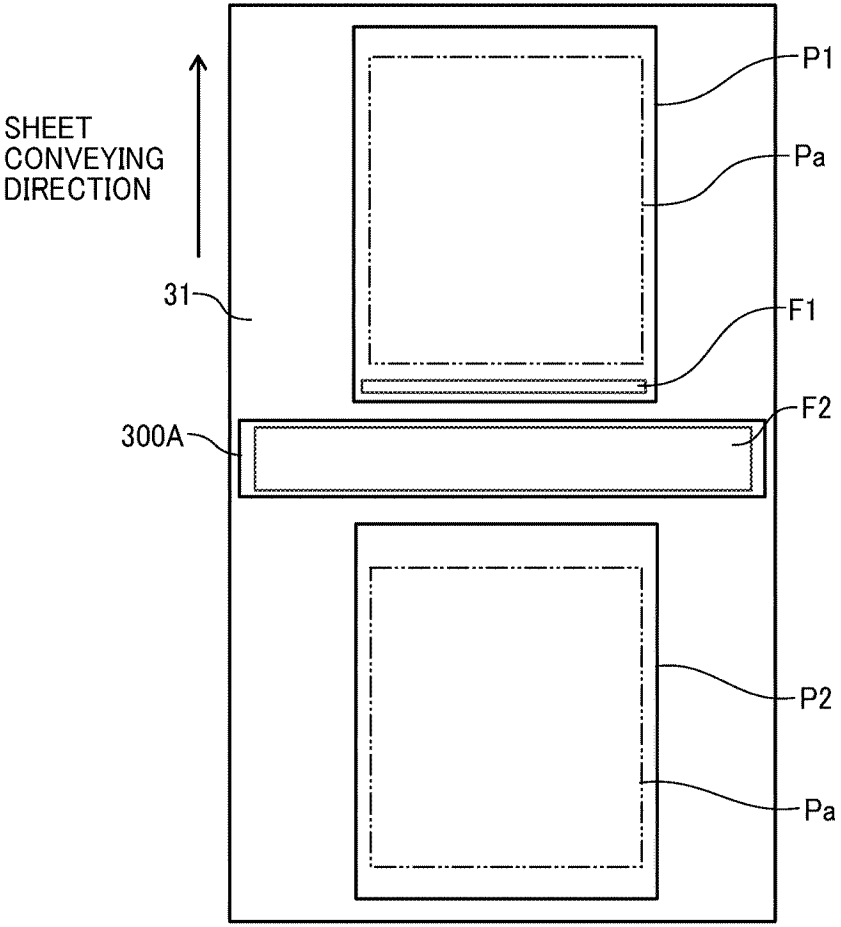
FIG. 14 is a plan view of a drum in a developed state, illustrating the control of the flushing operation according to the sixth embodiment of the present disclosure.

Referring now to FIGS. 13 and 14, a description is given of control of a flushing operation according to a sixth embodiment of the present disclosure.

FIG. 13 is a flowchart of the control of the flushing operation according to the sixth embodiment of the present disclosure. FIG. 14 is a plan view of the drum 31 in a developed state, illustrating the control of the flushing operation according to the sixth embodiment of the present disclosure.

In step S31, the flushing controller 801 determines a flushing condition for discharging liquid from the heads 101. Flushing conditions are stored in the memory 814. Here, the flushing controller 801 acquires flushing information for the trailing end field F1 of the preceding sheet P1 and the field F2 of the discharge receptacle 300A.

In step S32, the flushing controller 801 determines whether the trailing end field F1 of the preceding sheet P1 has reached a flushing position opposite the head array 100. When the flushing controller 801 determines that the trailing end field F1 of the preceding sheet P1 has not reached the flushing position (NO in step S32), the determination in step S32 is repeated. On the other hand, when the flushing controller 801 determines that the trailing end field F1 of the preceding sheet P1 has reached the flushing position (YES in step S32), in step S33, the flushing is performed to the trailing end field F1 of the preceding sheet P1. Specifically, the heads 101 discharge the liquid to the trailing end field F1 of the preceding sheet P1.

In step S34, the flushing controller 801 determines whether the field F2 of the discharge receptacle 300A has reached the flushing position opposite the head array 100. When the flushing controller 801 determines that the field F2 of the discharge receptacle 300A has not reached the flushing position (NO in step S34), the determination in step S34 is repeated. On the other hand, when the flushing controller 801 determines that the field F2 of the discharge receptacle 300A has reached the flushing position (YES in step S34), in step S35, the flushing is performed to the field F2 of the discharge receptacle 300A. Specifically, the heads 101 discharge the liquid to the field F2 of the discharge receptacle 300A.

Then, the process ends without performing the flushing when the leading end field F3 of the following sheet P2 reaches the flushing position opposite the head array 100.

In the present example, the flushing amount for flushing to the trailing end field F1 of the preceding sheet P1 is different from the flushing amount for flushing to the field F2 of the discharge receptacle 300A.

Accordingly, the flushing amount for flushing to the discharge receptacle 300 is reduced, resulting in extension of the replacement span of the discharge receptacle 300. The liquid consumption is also reduced.

In the present embodiment, a flushing amount V1 as a total number of drops discharged from one nozzle 111 to the trailing end field F1 and the field F2 of the discharge receptacle 300A is not less than a predetermined flushing amount V2 with which the nozzles 111 that are used for the print area Pa of the following sheet P2 can stably discharge the liquid.

Similar to the second embodiment, the flushing amount V1, which is a total number of drops discharged from one nozzle 111 to the trailing end field F1 and the field F2 and not less than the predetermined flushing amount V2 with which the nozzles 111 that are used for the print area Pa of the following sheet P2 can stably discharge the liquid, is dividable for flushing to the trailing end field F1 and the field F2.

Figure 15:
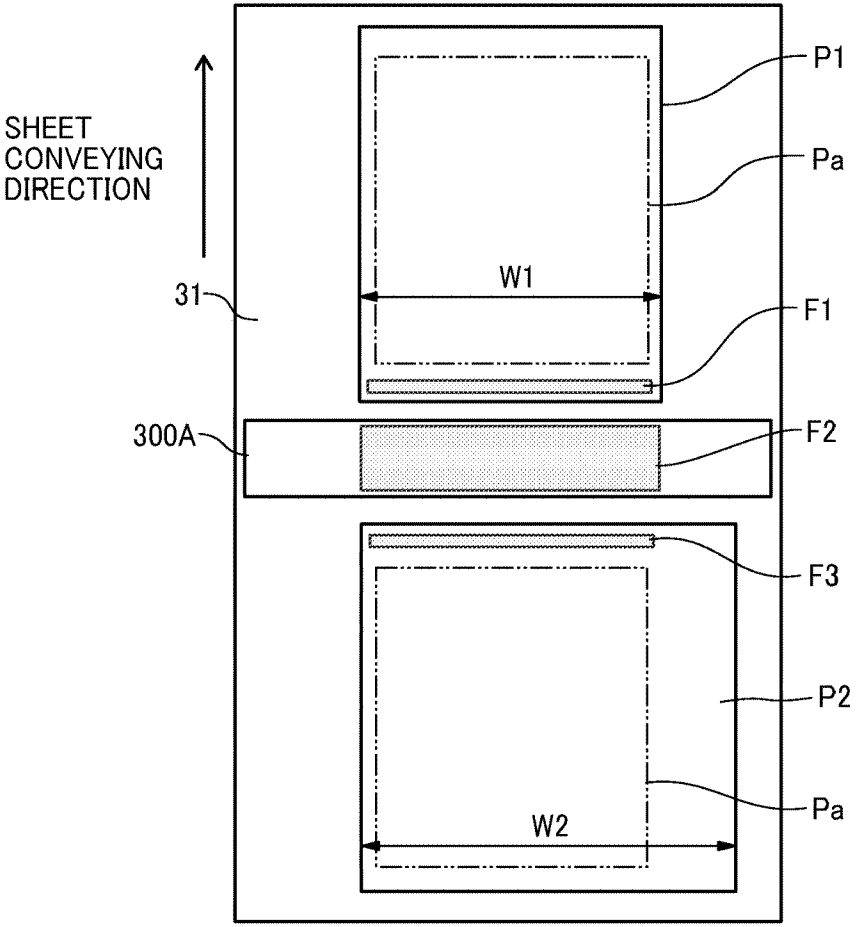
FIG. 15 is a plan view of a drum in a developed state, illustrating control of a flushing operation according to a seventh embodiment of the present disclosure.
Figure 16:
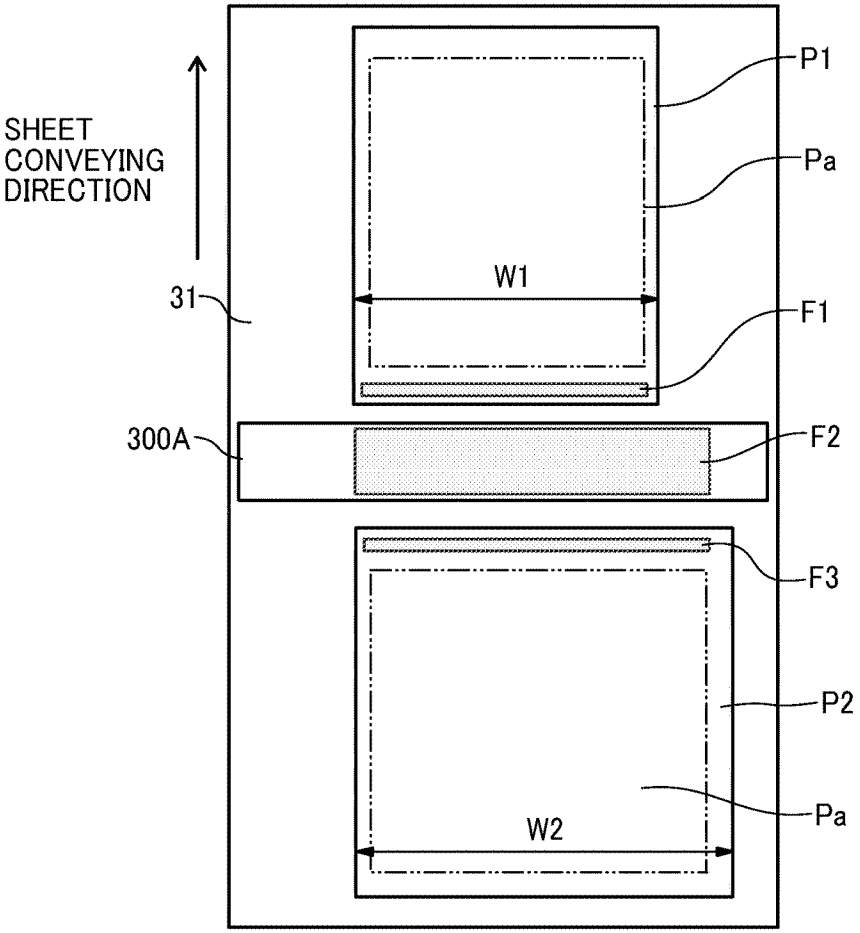
FIG. 16 is another plan view of a drum in a developed state, illustrating the control of the flushing operation according to the seventh embodiment of the present disclosure.

Referring now to FIGS. 15 and 16, a description is given of control of a flushing operation according to a seventh embodiment of the present disclosure.

FIG. 15 is a plan view of the drum 31 in a developed state, illustrating the control of the flushing operation according to the seventh embodiment of the present disclosure. FIG. 16 is another plan view of the drum 31 in a developed state, illustrating the control of the flushing operation according to the seventh embodiment of the present disclosure.

The present embodiment is an example of flushing in a case in which the preceding sheet P1 has a width W1 different from a width W2 of the following sheet P2. FIG. 15 illustrates an example in which the respective print areas Pa of the preceding sheet P1 and the following sheet P2 have identical widths. By contrast, FIG. 16 illustrates an example in which the respective print areas Pa of the preceding sheet P1 and the following sheet P2 have different widths.

In the present embodiment, the width (or length in the longitudinal direction of the discharge receptacle 300A) of the field F2 of the discharge receptacle 300A targeted for flushing from the heads 101 is determined according to the width of the print area Pa of the following sheet P2. The width of the leading end field F3 of the following sheet P2 is also determined according to the width of the print area Pa of the following sheet P2.

Thus, for stable liquid discharging, the leading end field F3 and the field F2 are determined according to the width of the print area Pa of the following sheet P2 and subjected to the flushing from the nozzles 111.

In the present example, the flushing amount for flushing to the field F2 is different from the flushing amount for flushing to the trailing end field F1. Similarly, the flushing amount for flushing to the field F2 is different from the flushing amount for flushing to the leading end field F3.

Accordingly, as compared with the embodiments described above, the flushing amount for flushing to the discharge receptacle 300 is further reduced, resulting in extension of the replacement span of the discharge receptacle 300 and reduction in frequency of replacement of the discharge receptacle 300. The liquid consumption is also reduced.

Note that the number of nozzles 111 that perform the flushing to the discharge receptacle 300A may be larger in the width direction of the sheet P than the nozzles 111 that are used for the print area Pa of the following sheet P2.

Accordingly, even when the following sheet P2 is displaced in the width direction of the sheet P or even when various sizes of sheets P are conveyed, the nozzles 111 that are used for the print area Pa of the following sheet P2 can stably discharge the liquid.

Figure 17:
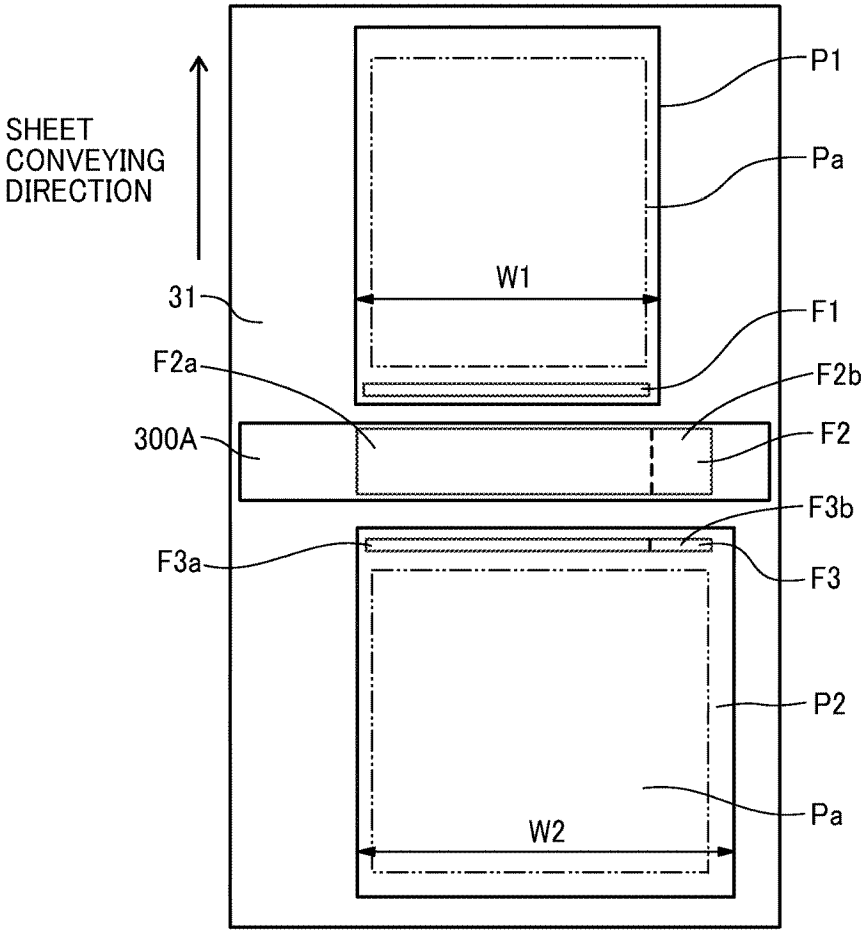
FIG. 17 is a plan view of a drum in a developed state, illustrating control of a flushing operation according to an eighth embodiment of the present disclosure.

Referring now to FIG. 17, a description is given of control of a flushing operation according to an eighth embodiment of the present disclosure.

FIG. 17 is a plan view of the drum 31 in a developed state, illustrating the control of the flushing operation according to the eighth embodiment of the present disclosure.

As in the seventh embodiment described above, a flushing amount V1 as a total number of drops discharged from one nozzle 111 to the trailing end field F1, the field F2, and the leading end field F3 is not less than a predetermined flushing amount V2 with which the nozzles 111 that are used for the print area Pa of the following sheet P2 can stably discharge the liquid. In the present embodiment, the flushing amount V1 is divided for flushing to the trailing end field F1, the field F2, and the leading end field F3.

For example, "6" is set as a flushing amount required for one nozzle 111, for stable liquid discharging to the print area Pa of the following sheet P2. In the present example, the flushing amount "6" is divided into a flushing amount "2" for flushing to the trailing end field F1 of the preceding sheet P1, a flushing amount "2" for flushing to the center field F2*a* of the field F2 of the discharge receptacle 300A, and a flushing amount "2" for flushing to a field F3*a* of the leading end field F3 of the following sheet P2.

On the other hand, "3" is set as a flushing amount for flushing to the longitudinal end field F2*b* of the field F2 of the discharge receptacle 300A and as a flushing amount for flushing to a field F3*b* of the leading end field F3 of the following sheet P2.

Alternatively, the respective flushing amounts for flushing to the trailing end field F1, the center field F2*a*, the longitudinal field F2*b*, the fields F3*a* and F3*b* may be different from each other. For example, the flushing amount may be two drops, one drop, and three drops for the trailing end field F1, the center field F2*a*, and the field F3*a*, respectively, whereas the flushing amount may be four drops and two drops for the longitudinal end field F2*b* and the field F3*b*, respectively.

Thus, in this case, the number of drops (i.e., flushing amount) for flushing to the center field F2*a* of the discharge receptacle 300A is different from the number of drops (i.e., flushing amount) for flushing to the longitudinal end field F2*b* of the discharge receptacle 300A.

Referring now to FIG. 18, a description is given of an example of the flushing amount required per nozzle together with the combinations of the trailing end field F1, the field F2, and the leading end field F3 targeted for flushing.

The memory 814 described above stores, e.g., information indicating the relationship between the combinations of the trailing end field F1, the field F2, and the leading end field F3 targeted for flushing and the flushing amount required per nozzle, as illustrated in FIG. 18.

In the example of FIG. 18, the flushing amount is "8" drops when the flushing is performed to each of the trailing end field F1, the field F2, and the leading end field F3. The flushing amount is "7" drops when the flushing is performed to one of the combination of the trailing end field F1 and the field F2, the combination of the trailing end field F1 and the leading end field F3, and the combination of the field F2 and the leading end field F3. The flushing amount is "6" drops when the flushing is performed to the field F2 alone. The number of drops listed here is an example and is not limited to the numbers described above.

The flushing controller 801 reads out, from the memory 814, one of the combinations of the trailing end field F1, the field F2, and the leading end field F3 targeted for flushing and the flushing amount required per nozzle as in the aforementioned example, to determine the flushing condition described in the embodiments above.

Thus, different flushing amounts required per nozzle may be determined depending on the combination of the areas targeted for flushing or the number of the areas.

Referring now to FIG. 19, a description is given of a ninth embodiment of the present disclosure.

FIG. 19 is a table presenting a relationship between print conditions and the applicability of flushing to a sheet, according to the ninth embodiment of the present disclosure.

In the present embodiment, the applicability of flushing (in other words, whether the flushing can be performed) to the trailing end field F1 of the preceding sheet P1 and the leading end field F3 of the following sheet P2 is determined for each of print conditions A, B, and C and stored in the memory 814.

Examples of the print conditions include, but are not limited to, image quality, speed, and print side. For example, the image quality may be classified into high image quality, medium image quality, and low image quality. The speed may be classified into high speed, medium speed, and low speed. The print side may be classified into double-sided printing (i.e., double print sides) and single-sided printing (i.e., single print side).

In the example of FIG. 19, under the print condition A, the trailing end field F1 is subjected to flushing, whereas the leading end field F3 is not subjected to flushing. Under the print condition B, the flushing is performed on both the trailing end field F1 and the leading end field F3. Under the print condition C, the trailing end field F1 is not subjected to flushing; whereas the leading end field F3 is subjected to flushing.

The flushing controller 801 reads out, from the memory 814, the relationship between the print conditions and the areas targeted for flushing as in the aforementioned example, to determine the flushing condition described in the embodiments above.

Figure 20A:
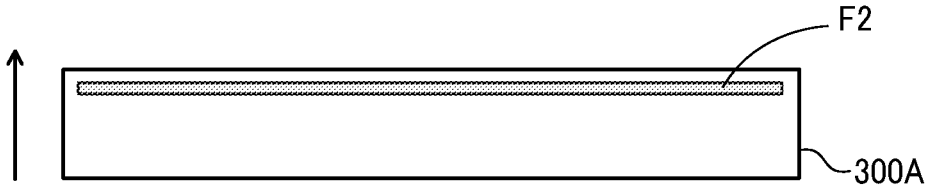
FIG. 20A is an illustration of a position of a flushing area in a discharge receptacle according to a tenth embodiment of the present disclosure.
Figure 20B:
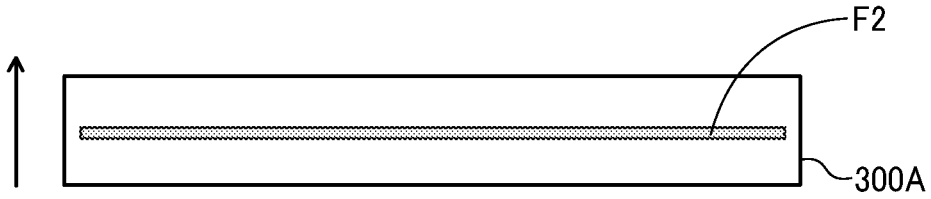
FIG. 20B is an illustration of another position of the flushing area in the discharge receptacle of FIG. 20A.
Figure 20C:
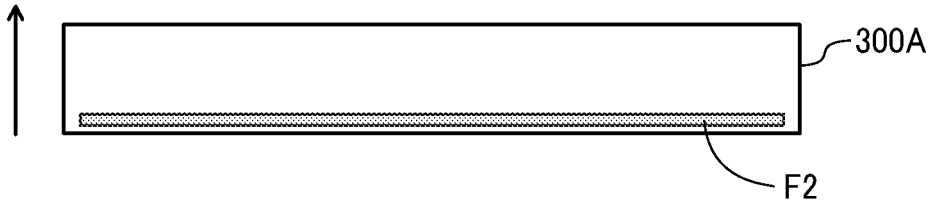
FIG. 20C is an illustration of yet another position of the flushing area in the discharge receptacle of FIG. 20A.

Thus, the area targeted for flushing is selectable according to the print conditions. Referring now to FIGS. 20A to 20C, a description is given of a tenth embodiment of the present disclosure.

FIG. 20A is an illustration of a position of a flushing area in a discharge receptacle according to the tenth embodiment of the present disclosure. FIG. 20B is an illustration of another position of the flushing area in the discharge receptacle of FIG. 20A. FIG. 20C is an illustration of yet another position of the flushing area in the discharge receptacle of FIG. 20A.

In the present embodiment, the position of the flushing field F2 of the discharge receptacle 300A is changed in the sheet conveying direction.

For example, as illustrated in FIG. 20A, the heads 101 discharge the liquid as a flushing operation to the most downstream position of the discharge receptacle 300A in the direction of rotation of the drum 31 (i.e., moving direction of the discharge receptacle 300A) indicated by arrow in FIG. 20A. Subsequently, when the discharge receptacle 300A comes to a position opposite the heads 101, or when a given amount of liquid adheres to the position illustrated in FIG. 20A, the flushing field F2 is moved in the sheet conveying direction to a position as illustrated in FIG. 20B. Further, in the same manner, the flushing field F2 is moved in the sheet conveying direction to a position as illustrated in FIG. 20C.

Such changes to the position of the field F2 targeted for flushing within the discharge receptacle 300 extends the replacement span of the discharge receptacle 300 and reduces the frequency of replacement of the discharge receptacle 300.

Figure 21A:
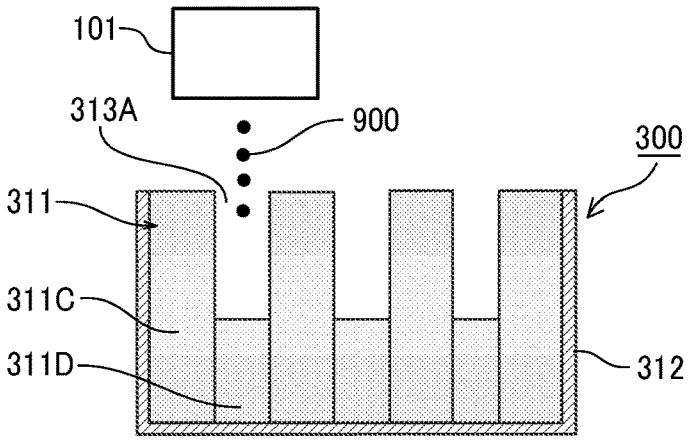
FIG. 21A is a cross-sectional view of a discharge receptacle in a short direction of the discharge receptacle, illustrating a flushing operation to the discharge receptacle according to the tenth embodiment of the present disclosure.
Figure 21B:
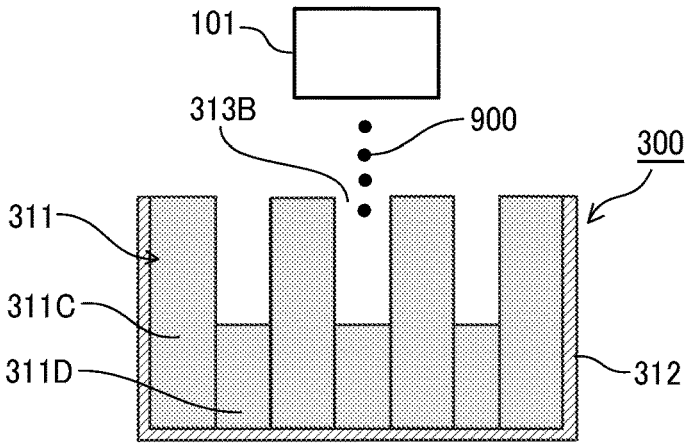
FIG. 21B is a cross-sectional view of the discharge receptacle of FIG. 21A in the short direction of the discharge receptacle, illustrating another flushing operation to the discharge receptacle.
Figure 21C:
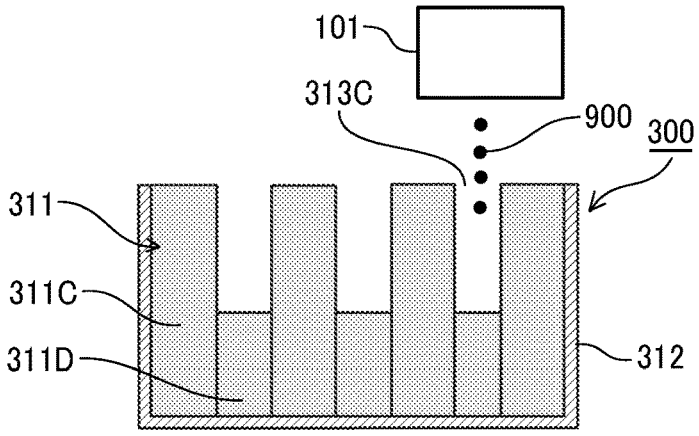
FIG. 21C is a cross-sectional view of the discharge receptacle of FIG. 21A in the short direction of the discharge receptacle, illustrating yet another flushing operation to the discharge receptacle.

Referring now to FIGS. 21A to 21C, a description is given of a discharge receptacle used in the tenth embodiment described above.

FIG. 21A is a cross-sectional view of a discharge receptacle in a short direction of the discharge receptacle, illustrating a flushing operation to the discharge receptacle according to the tenth embodiment of the present disclosure. FIG. 21B is a cross-sectional view of the discharge receptacle of FIG. 21A in the short direction of the discharge receptacle, illustrating another flushing operation to the discharge receptacle. FIG. 21C is a cross-sectional view of the discharge receptacle of FIG. 21A in the short direction of the discharge receptacle, illustrating yet another flushing operation to the discharge receptacle.

The discharge receptacle 300 includes an absorber 311 and a storage case 312 as a housing that houses the absorber 311.

The absorber 311 is provided with slits 313 along the longitudinal direction of the discharge receptacle 300, which is parallel to an axial direction of the drum 31 and perpendicular to the sheet conveying direction. In the present embodiment, the slits 313 include three slits (specifically, first slit 313A to third slit 313C) arranged side by side in the sheet conveying direction to change the location of the field F2 to three positions.

In the present embodiment, the absorber 311 includes absorbing parts 311C and 311D having different lengths. Specifically, the absorbing part 311C is longer than the absorbing part 311D. The absorbing parts 311C and 311D are arranged alternately so as to sandwich the shorter absorbing part 311D between the longer absorbing parts 311C. Above the absorbing parts 311D are the slits 313.

In selection of one of the slits 313 as a target of liquid discharging, the flushing controller 801 determines whether a certain amount of liquid has been discharged to the first slit 313A. When a certain amount of liquid has not been discharged to the first slit 313A, the flushing controller 801 selects the first slit 313A as a target of liquid discharging. Accordingly, as illustrated in FIG. 21A, for example, liquid 900 is discharged from the head 101 to the first slit 313A as the field F2.

On the other hand, when a certain amount of liquid has been discharged to the first slit 313A, the flushing controller 801 determines whether a certain amount of liquid has been discharged to the second slit 313B. When a certain amount of liquid has not been discharged to the second slit 313B, the flushing controller 801 selects the second slit 313B as a target of liquid discharging. Accordingly, as illustrated in FIG. 21B, for example, the liquid 900 is discharged from the head 101 to the second slit 313B as the field F2.

On the other hand, when a certain amount of liquid has been discharged to the second slit 313B, the flushing controller 801 selects the third slit 313C as a target of liquid discharging. Accordingly, as illustrated in FIG. 21C, for example, the liquid 900 is discharged from the head 101 to the third slit 313C selected.

When a certain amount of liquid is discharged to the third slit 313C, a flag indicating that a certain amount of liquid is discharged to the slit 313 is reset for each of the slits 313. Accordingly, the liquid discharging starts again from the first slit 313A next time.

In short, in a case in which the discharge receptacle 300 includes a plurality of slits 313, the accumulation of waste liquid can be dispersed to each of the slits 313 by switching a target of liquid discharging between the slits 313 each time when a certain amount of liquid is discharged, thus widening the area to deposit the waste liquid. In addition, when liquid that is easy to dry is used, continuous discharging of the liquid up to a certain amount to one slit 313 hampers drying of the surface of the waste liquid that has landed on the discharge receptacle 300, thus reducing the accumulation rate of the waste liquid.

In the embodiments described above, the flushing amount refers to an amount of flushing required for one nozzle 111. Alternatively, the flushing amount may be an amount of flushing required for one head 101 of the head array 100.

Figure 22:
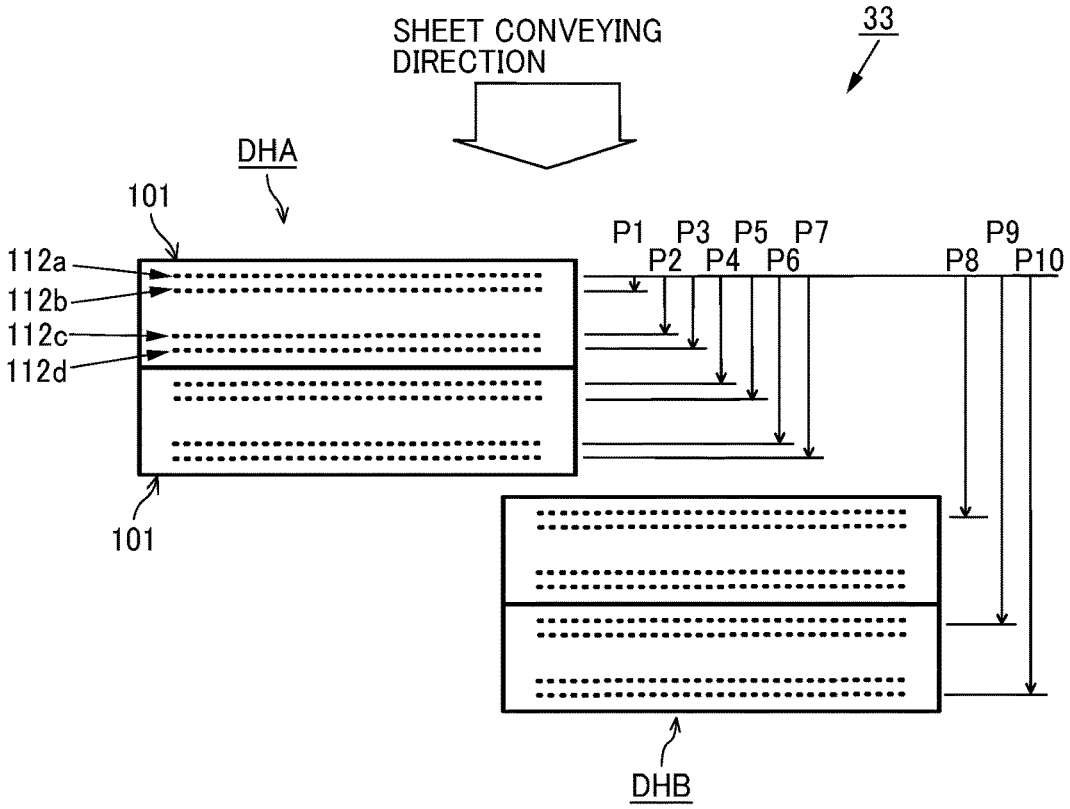
FIG. 22 is an illustration of the timing adjustment of flushing from nozzle rows of each head in flushing control according to an eleventh embodiment of the present disclosure.

Referring now to FIG. 22, a description is given of an eleventh embodiment of the present disclosure.

FIG. 22 is an illustration of the timing adjustment of flushing from nozzle rows of each head in flushing control according to the eleventh embodiment of the present disclosure. In the present embodiment, each of the heads 101 includes four nozzle rows 112 (specifically, nozzle rows 112*a* to 112*d*). Each of the four nozzle rows 112 is an array of nozzles 111. Each of dual heads DH (specifically, dual heads DHA and DHB) is a set of two heads 101 arranged side by side in the sheet conveying direction. The dual heads DH are arranged in a staggered manner in the direction perpendicular to the sheet conveying direction.

After the flushing driving information is input to each of the heads 101, the head driving controller 803 described above generates flushing data at the time of starting the flushing for each of the nozzle rows 112 of each of the heads 101 to cause the heads 101 to perform the flushing. At this time, in consideration of the physical relative positions of the nozzle rows 112, the flushing timing is adjusted such that the flushing is performed in a line shape in the discharge receptacles 300 (specifically, the discharge receptacles 300A to 300C).

Specifically, the flushing timing is adjusted for each of the nozzle rows 112 with a multiplied signal of the encoder signal. The input of the multiplied signal of the encoder signal by a given number of pulses is counted to start flushing for each of the nozzle rows 112. Thus, the accuracy of timing adjustment in enhanced in consideration of the fluctuation in rotation of the drum 31.

More specifically, when the liquid is discharged to the sheet P at 1200 dpi, for example, the multiplied signal of the encoder signal is generated according to the cycle of discharging the liquid at 1200 dpi. Each of the nozzle rows 112 is controlled by the number of delayed cycles (specifically, P1 to P10) to discharge the liquid as illustrated in FIG. 22. In this case, the flushing timing may be adjusted with a signal other than the multiplied signal of the encoder signal. For example, the pulses generated by a general crystal oscillator may be counted for each of the nozzle rows 112 to start the flushing for each of the nozzle rows 112.

Figure 23:
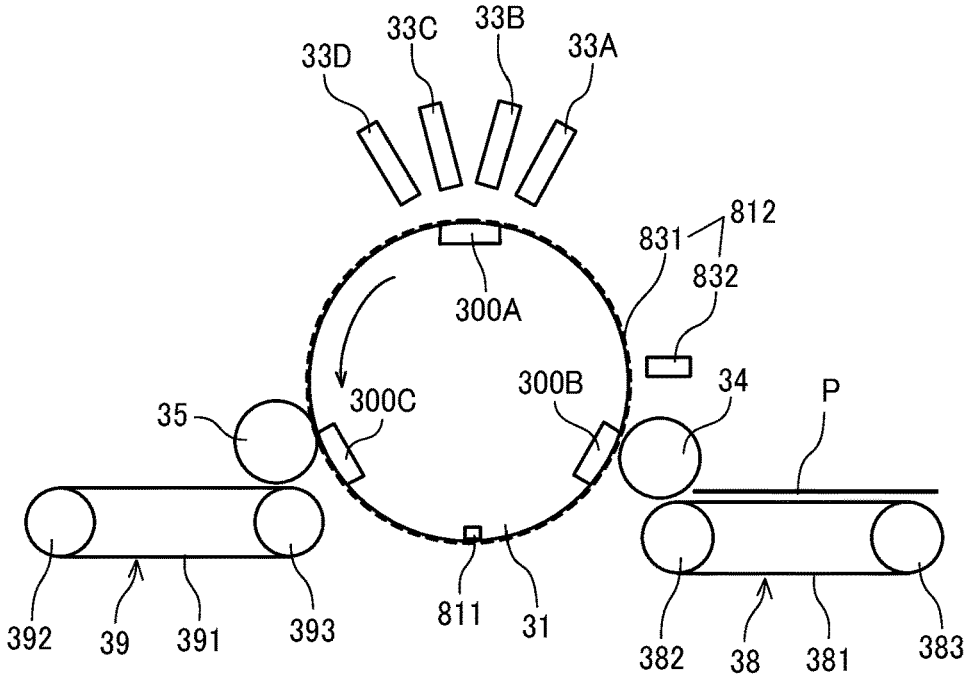
FIG. 23 is an illustration around a printing device according to a twelfth embodiment of the present disclosure.
Figure 24:
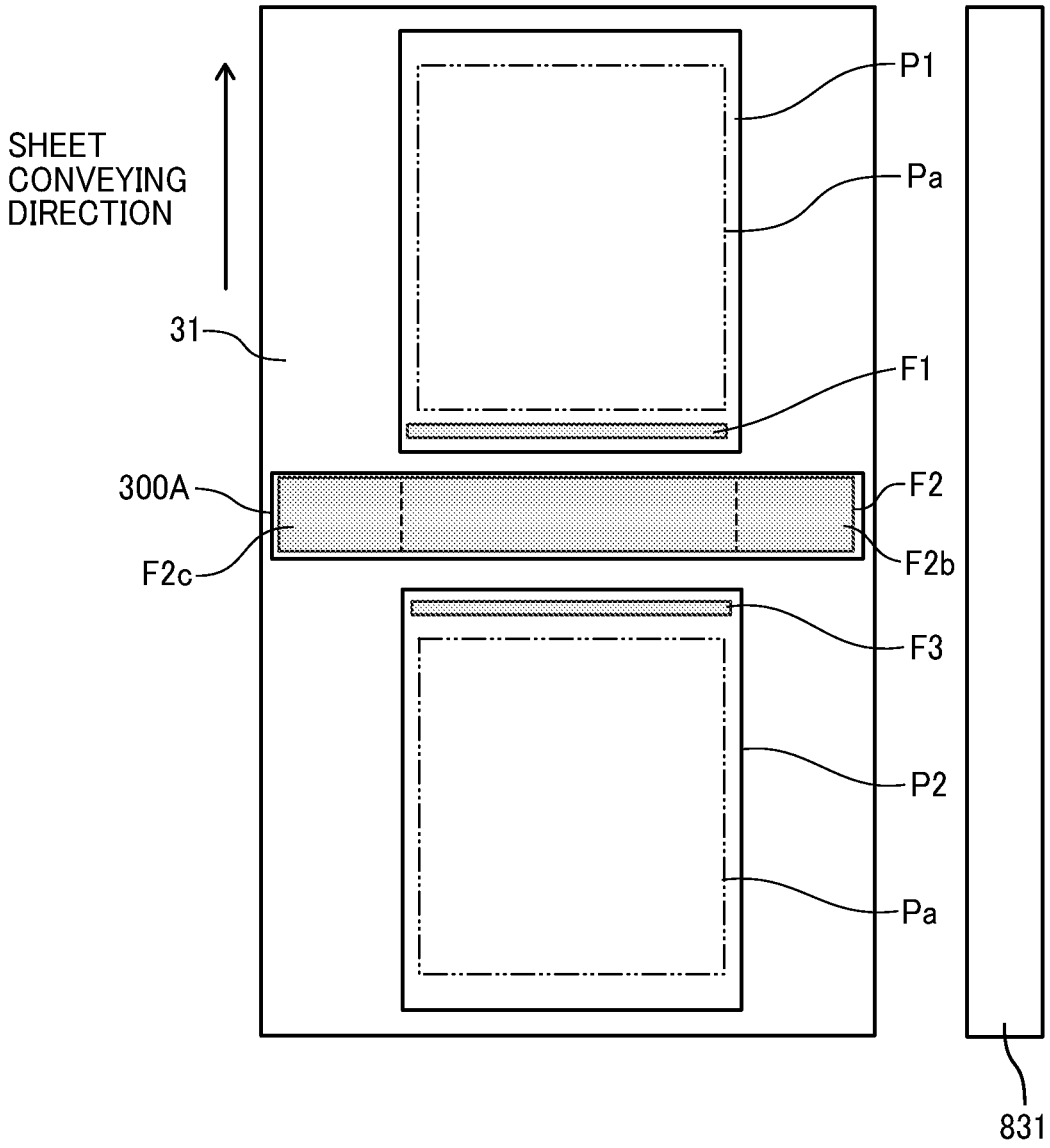
FIG. 24 is a developed illustration around a discharge receptacle according to the twelfth embodiment of the present disclosure.

Referring now to FIGS. 23 and 24, a description is given of a twelfth embodiment of the present disclosure.

FIG. 23 is an illustration around a printing device according to the twelfth embodiment of the present disclosure. FIG. 24 is a developed illustration around a discharge receptacle according to the twelfth embodiment of the present disclosure.

In the present embodiment, a conveyor 38 is disposed upstream from the transfer cylinder 34 in the sheet conveying direction, whereas a conveyor 39 is disposed downstream from the transfer cylinder 35 in the sheet conveying direction.

The conveyor 38 includes an endless belt 381 that conveys the sheet P. The conveyor 38 further includes a driving roller 382 and a driven roller 383. The belt 381 is entrained around the driving roller 382 and the driven roller 383. The belt 381 rotates to convey the sheet P. The sheet P is transferred from the belt 381 to the transfer cylinder 34.

The conveyor 39 includes an endless belt 391 that conveys the sheet P. The conveyor 39 further includes a driving roller 392 and a driven roller 393. The belt 391 is entrained around the driving roller 392 and the driven roller 393. The belt 391 rotates to convey the sheet P. The conveyor 39 receives the sheet P from the transfer cylinder 35 and conveys the received sheet P to the first drying device 40.

Note that, in the present embodiment, the conveyors 41 and 51 of the first embodiment include the conveyor 39 to convey the sheet P across the first drying device 40 and the second drying device 50.

In the present embodiment, the encoder 812 that detects a circumferential position of the drum 31 is a linear encoder constructed of an encoder sheet 831 disposed on the circumferential surface of the drum 31 and an encoder sensor 832 that reads the encoder sheet 831.

The linear encoder thus used as the encoder 812 reduces the influence of the eccentricity of the drum 31 and detects the circumferential position (or amount of rotation) of the drum 31 with an enhanced accuracy.

Accordingly, for example, the present embodiment enhances the accuracy of timing of the flushing control for each of the nozzle rows 112 as described above in the eleventh embodiment.

Similarly, as described above in the first embodiment, detecting the leading end of the sheet P and counting the encoder signals enhances determination of an accurate flushing position at the leading end portion of the sheet P or the trailing end portion of the sheet P.

Similarly, the present embodiment enhances the accuracy of detecting the location of the discharge receptacle 300 as described above in the first embodiment and the accuracy of detecting a flushing position within one discharge receptacle 300 in the direction of rotation of the drum 31 as described above in the tenth embodiment.

Figures 25, 26:
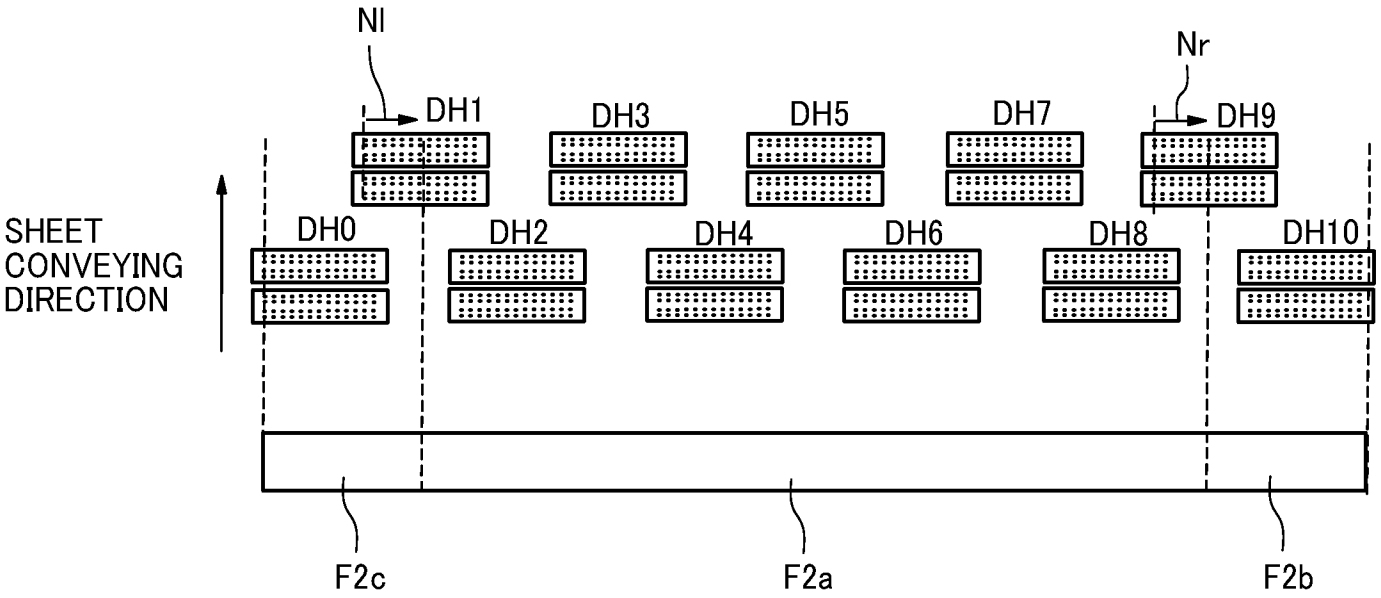
FIG. 25 is an illustration of flushing control according to a thirteenth embodiment of the present disclosure.
FIG. 26 is a table presenting conditions for controlling the flushing to a sheet, according to a fourteenth embodiment of the present disclosure.

Referring now to FIG. 25, a description is given of a thirteenth embodiment of the present disclosure.

FIG. 25 is an illustration of flushing control according to the thirteenth embodiment of the present disclosure.

Here, as in the eleventh embodiment described above, the discharge unit 33 includes the dual heads DH (specifically, dual heads DH0 to DH10) arranged in a staggered manner in the direction perpendicular to the sheet conveying direction. As described above, each of the dual heads DH is a set of two heads 101 arranged side by side in the sheet conveying direction.

The entire flushing area (i.e., F2) is divided into a left flushing area (i.e., longitudinal end field F2*c*), a center flushing area (i.e., center field F2*a*), and a right flushing area (i.e., longitudinal end field F2*b*) as illustrated in FIG. 25. The flushing amount is controlled to be different between the left, center, and right flushing areas. For example, drops may be discharged in different numbers to the left, center, and right flushing areas as described above in the eighth embodiment.

That is, as in the eleventh embodiment described above, in consideration of the physical relative positions of the nozzle rows 112, the head driving controller 803 generates the flushing data at the time of starting the flushing for each of the nozzle rows 112 of each of the heads 101 to cause the heads 101 to perform the flushing.

For example, in order to control the number of drops for flushing to the longitudinal end fields F2*b* and F2*c* of the discharge receptacle 300A, a boundary setting of flushing nozzle boundaries (specifically, a left end nozzle boundary N1 and a right end nozzle boundary Nr) is input from the top as illustrated in FIG. 25.

Then, the head driving controller 803 converts the boundary setting to a boundary setting for each of the dual heads DH or for each of the heads 101. The boundary setting for each of the dual heads DH is converted into a boundary setting for each of the nozzle rows 112 of each of the dual heads DH. The boundary setting for each of the nozzle rows 112 is input to a flushing data generation controller for each of the nozzle rows 112 of each of the dual heads DH. The flushing data generation controller for each of the nozzle rows 112 includes data generation controllers for the left and right sides of the boundary, respectively, to perform two types of flushing control with the flushing data for both sides of the boundary.

For example, the head driving controller 803 changes and sets the nozzle boundary to the center or around the center of the nozzle row 112 (i.e., any part in the middle of the nozzle row 112) in each of the dual head DH1 and the dual head DH9 according to the width of the sheet P. Different flushing controls are performed on the left and right nozzles 111 of the boundary defined in the head 101.

Accordingly, regardless of the number of nozzles 111 for each of the heads 101, the flushing amount (i.e., amount of liquid discharged for flushing) can be different between the center field F2*a* and the longitudinal end fields F2*b* and F2*c* according to the width of the sheet P or the conveyance condition of the sheet P.

Referring now to FIG. 26, a description is given of a fourteenth embodiment of the present disclosure.

FIG. 26 is a table presenting conditions for controlling the flushing to the sheet P, according to the fourteenth embodiment of the present disclosure.

In the present embodiment, when the sheet P is subjected to flushing, the area targeted for flushing is determined according to the print conditions for front-to-back alignment (that is, aligning the image position on the front side of the sheet P and the image position on the back side of the sheet P).

Specifically, since the leading end and the trailing end on the front side of the sheet P is marked for the front-to-back alignment at the time of printing on the back side of the sheet P, the leading end field F3 and trailing end field F1 on the front side of the sheet P are not subjected to flushing (as indicated by dashes in the table of FIG. 26) when the front-to-back alignment is "YES" in the table of FIG. 26.

Since the back side of the sheet P is printed after the front side of the sheet P is printed, the back side of the sheet P is not marked for the front-to-back alignment. Therefore, the leading end field F3 and the trailing end field F1 on the back side of the sheet P are subjected to flushing (as indicated by circles in the table of FIG. 26).

By contrast, since the sheet P is not marked for the front-to-back alignment when the front-to-back alignment is "NO" in the table of FIG. 26, the leading end field F3 and the trailing end field F1 on each of the front and back sides of the sheet P are subjected to flushing (as indicated by circles in the table of FIG. 26).

In the embodiments of the present disclosure, the liquid to be discharged is not limited to a particular liquid provided that the liquid has a viscosity or surface tension dischargeable from a head. However, preferably, the viscosity of the liquid is not greater than 30 mPa·s under ordinary temperature and ordinary pressure or by heating or cooling. Specific examples of the liquid include, but are not limited to, a solution, a suspension, or an emulsion including, e.g., a solvent such as water or an organic solvent, a colorant such as dye or pigment, a functional material such as a polymerizable compound, a resin, or a surfactant, a biocompatible material such as deoxyribonucleic acid (DNA), amino acid, protein, or calcium, and an edible material such as a natural colorant. Such a solution, a suspension, or an emulsion can be used for, e.g., an inkjet ink, a surface treatment solution, a liquid for forming components of an electronic element or a light-emitting element or a resist pattern of an electronic circuit, or a material solution for three-dimensional fabrication.

Examples of an energy source for generating energy to discharge liquid include, but are not limited to, a piezoelectric actuator (e.g., a laminated piezoelectric element or a thin-film piezoelectric element), a thermal actuator that employs a thermoelectric conversion element such as a thermal resistor, and an electrostatic actuator including a diaphragm and opposed electrodes.

Examples of the "liquid discharge apparatus" include, but are not limited to, an apparatus that discharges liquid to a material to which liquid is adherable and an apparatus that discharges liquid into gas or liquid.

The "liquid discharge apparatus" may include at least one of devices for feeding, conveying, and ejecting a material to which liquid is adherable. The liquid discharge apparatus may further include at least one of a pre-processing device and a post-processing device.

Specific examples of the "liquid discharge apparatus" include, but are not limited to, an image forming apparatus that discharges ink to form an image on a sheet and a three-dimensional fabricating apparatus that discharges a fabrication liquid to layered powder to fabricate a three-dimensional object.

The "liquid discharge apparatus" is not limited to an apparatus that discharges liquid to visualize meaningful images such as letters or figures. For example, the "liquid discharge apparatus" may be an apparatus that forms meaningless images such as meaningless patterns or an apparatus that fabricates three-dimensional images.

The aforementioned term "material to which liquid is adherable" denotes, e.g., a material to which liquid is adherable at least temporarily, a material to which liquid adheres and is fixed, or a material which liquid adheres to and permeates. Specific examples of the "material to which liquid is adherable" include, but are not limited to, a recording medium such as a paper sheet, recording paper, a recording sheet of paper, a film, or cloth, an electronic component such as an electronic substrate or a piezoelectric element, and a medium such as layered powder, an organ model, or a testing cell. The "material to which liquid is adherable" includes any material to which liquid is adhered, unless particularly limited.

The "material to which liquid is adherable" is made of any material provided that liquid is adherable at least temporarily to the material. For example, the "material to which liquid is adherable" may be made of paper, threads, fibers, fabric, leather, metal, plastic, glass, wood, or ceramic.

The "liquid discharge apparatus" may be an apparatus that relatively moves a liquid discharge head and a material to which liquid is adherable. However, the liquid discharge apparatus is not limited to such an apparatus. For example, the "liquid discharge apparatus" may be a serial head apparatus that moves the liquid discharge head or a line head apparatus that does not move the liquid discharge head.

Other than the examples of the "liquid discharge apparatus" described above, the "liquid discharge apparatus" may be a treatment liquid applying apparatus that discharges and applies a treatment liquid onto a sheet surface to reform the sheet surface or an injection granulation apparatus that injects a composition liquid including raw materials dispersed in a solution through nozzles to granulate fine particles of the raw materials.

The terms "image formation", "recording", "printing", "image printing", and "fabricating" are herein used as synonyms.

According to the embodiments of the present disclosure, the frequency of replacement of the discharge receptacle is reduced.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. A liquid discharge apparatus comprising:

a liquid discharger including a nozzle configured to discharge liquid;

a conveyor configured to convey sheets to which the liquid is discharged from the liquid discharger, wherein the conveyor conveys sheets in a sheet conveying direction;

a discharge receptacle configured to receive the liquid discharged from the liquid discharger; and circuitry configured to control a flushing operation of the liquid discharger, the circuitry being configured to cause the liquid discharger to perform flushing to the discharge receptacle with different amounts of flushing to different areas of the discharge receptacle, including a first flushing amount, and to perform flushing to the sheets to which the liquid is applied with a second flushing amount, with the first flushing amount and the second flushing amount being different from each other, respectively, wherein flushing to one or more of the sheets comprises flushing to a trailing end portion of at least one sheet and flushing to a leading end portion of at least one sheet, wherein flushing to a sheet is determined according to a corresponding print condition for the sheet, wherein the discharge receptacle is located between positions for the sheets on the conveyor, and includes a plurality of areas to which the liquid discharger performs flushing with different flushing amounts.

2. The liquid discharge apparatus according to claim 1, wherein the liquid discharger is a head array including a plurality of heads arrayed to discharge the liquid, wherein each of the plurality of heads includes a plurality of nozzles including the nozzle, and wherein the circuitry is configured to change a flushing amount per nozzle for each of the plurality of heads in the discharge receptacle.

3. The liquid discharge apparatus according to claim 1, wherein the liquid discharger includes a plurality of nozzles including the nozzle, and wherein the circuitry is configured to change a flushing amount per nozzle for each of the plurality of nozzles in the discharge receptacle.

4. The liquid discharge apparatus according to claim 1, wherein the circuitry is configured, when causing the liquid discharger to perform the flushing to a sheet, to change a length of an area targeted for the flushing of the sheet in a direction perpendicular to the sheet conveying direction, according to a length of the sheet in the direction perpendicular to the sheet conveying direction.

5. The liquid discharge apparatus according to claim 1, wherein the discharge receptacle includes an area that does not face a sheet, and wherein the circuitry is configured, when causing the liquid discharger to perform the flushing to the discharge receptacle, not to cause the liquid discharger to perform the flushing to the area that does not face the sheet for each time when the sheet passes by the discharge receptacle.

6. The liquid discharge apparatus according to claim 1, wherein the liquid discharger includes a plurality of nozzles including the nozzle, and wherein the circuitry is configured to change a flushing amount per nozzle according to a number of areas targeted for the flushing.

7. The liquid discharge apparatus according to claim 1, wherein the conveyor comprises a rotatable drum having a circumference, wherein the apparatus comprises a plurality of discharge receptacles, including the discharge receptacle, located on the drum configured to receive the liquid discharged from the liquid discharger, wherein the plurality of discharge receptacles are located around the circumference of the drum, between positions for the sheets on the drum, at substantially equal angles between positions for the sheets on the rotatable drum, and wherein the circuitry is further configured to cause the liquid discharger to selectively perform flushing to one or more of the plurality of discharge receptacles.

8. A liquid discharge apparatus comprising:

a liquid discharger including a nozzle configured to discharge liquid;

a conveyor configured to convey sheets to which the liquid is discharged from the liquid discharger, wherein the conveyor conveys sheets in a sheet conveying direction;

a discharge receptacle configured to receive the liquid discharged from the liquid discharger; and circuitry configured to control a flushing operation of the liquid discharger, the circuitry being configured to cause the liquid discharger to perform flushing to the discharge receptacle and a sheet to which the liquid is applied, the circuitry being configured to cause the liquid discharger to perform the flushing to the discharge receptacle with different amounts of flushing to different areas of the discharge receptacle, including a first flushing amount, and to perform the flushing to the sheet with a second flushing amount, wherein flushing to the sheet comprises flushing onto a trailing end portion of the sheet and flushing onto a leading end portion of the sheet, wherein the discharge receptacle is located between positions for the sheets on the conveyor, and includes a plurality of areas to which the liquid discharger performs flushing with different flushing amounts.

9. The liquid discharge apparatus according to claim 8, wherein the liquid discharger is a head array including a plurality of heads arrayed to discharge the liquid, wherein each of the plurality of heads includes a plurality of nozzles including the nozzle, and wherein the circuitry is configured to change a flushing amount per nozzle for each of the plurality of heads in the discharge receptacle.

10. The liquid discharge apparatus according to claim 8, wherein the liquid discharger includes a plurality of nozzles including the nozzle, and wherein the circuitry is configured to change a flushing amount per nozzle for each of the plurality of nozzles in the discharge receptacle.

11. The liquid discharge apparatus according to claim 8, wherein the circuitry is configured, when causing the liquid discharger to perform the flushing to the sheet, to change a length of an area targeted for the flushing of the sheet in a direction perpendicular to the sheet conveying direction, according to a length of the sheet in the direction perpendicular to the sheet conveying direction.

12. The liquid discharge apparatus according to claim 8, wherein the discharge receptacle includes an area that does not face the sheet, and wherein the circuitry is configured, when causing the liquid discharger to perform the flushing to the discharge receptacle, not to cause the liquid discharger to perform the flushing to the area that does not face the sheet for each time when the sheet passes by the discharge receptacle.

13. The liquid discharge apparatus according to claim 8, wherein the conveyor comprises a rotatable drum having a circumference, wherein the apparatus comprises a plurality of discharge receptacles, including the discharge receptacle, located on the drum configured to receive the liquid discharged from the liquid discharger, wherein the plurality of discharge receptacles are located around the circumference of the drum, between positions for the sheets on the drum, at substantially equal angles between positions for the sheets on the rotatable drum, and wherein the circuitry is further configured to cause the liquid discharger to selectively perform flushing to one or more of the plurality of discharge receptacles.

* * * * *